US007677412B2

(12) United States Patent
Litterst et al.

(10) Patent No.: US 7,677,412 B2
(45) Date of Patent: Mar. 16, 2010

(54) FLUID DISPENSING SYSTEM SUITABLE FOR DISPENSING LIQUID FLAVORINGS

(75) Inventors: Charles Litterst, Thornhill (CA); Richard Fine, Mississauga (CA)

(73) Assignee: Zavida Coffee Company Inc., Concord (CA)

( * ) Notice: Subject to any disclaimer, the term of this patent is extended or adjusted under 35 U.S.C. 154(b) by 0 days.

(21) Appl. No.: 12/179,704

(22) Filed: Jul. 25, 2008

(65) Prior Publication Data

US 2009/0020553 A1 Jan. 22, 2009

Related U.S. Application Data

(63) Continuation of application No. 10/964,673, filed on Oct. 15, 2004, now Pat. No. 7,494,028.

(60) Provisional application No. 60/572,605, filed on May 20, 2004, provisional application No. 60/511,121, filed on Oct. 15, 2003.

(51) Int. Cl.
*B67B 7/00* (2006.01)

(52) U.S. Cl. ..... 222/1; 222/333; 222/129.1

(58) Field of Classification Search ..... 222/1, 222/24–28, 55, 66, 39, 333, 129.1–129.4, 222/146.1, 52, 63, 71, 400.5; 417/44.1
See application file for complete search history.

(56) References Cited

U.S. PATENT DOCUMENTS 3,651,989 A * 3/1972 Westrich ..... 222/14
3,756,456 A 9/1973 Georgi et al.
3,756,463 A 9/1973 Gravina
4,124,045 A 11/1978 Slywka
4,189,067 A 2/1980 Nottke et al.
4,202,387 A * 5/1980 Upton ..... 141/360
4,309,153 A 1/1982 Panick et al.
4,365,728 A 12/1982 Tokorozawa et al.

(Continued)

FOREIGN PATENT DOCUMENTS

DE 100 30 788.4-52 6/2000

OTHER PUBLICATIONS

PCT International Search Report, PCT Application No. PCT/CA2007/001425, dated Dec. 10, 2007.

(Continued)

*Primary Examiner*—Lien T Ngo
(74) *Attorney, Agent, or Firm*—Berskin & Parr LLP

(57) ABSTRACT

A fluid dispensing apparatus includes a pulse generator coupled to a pump that operates in discrete cycles. Each cycle includes a first part in which fluid is drawn into the pump through an inlet, and a second part in which fluid is expelled from the pump through an outlet. Each cycle results in a discrete, consistent volume of fluid being expelled. The pulse generator transmits discrete pulses to the pump, causing the pump to operate for a set number of cycles per pulse. The total number of cycles is a multiple of the number of pulses transmitted, so that the number of pulses determines the volume of fluid dispensed. Alternatively, the pump is driven through increments of the second part of the cycle, with the number of pulses supplied to the pump determining the proportion of the second part of the cycle completed, and therefore the volume of fluid dispensed.

18 Claims, 17 Drawing Sheets

U.S. PATENT DOCUMENTS

| | | | | | |
|---|---|---|---|---|---|
| 4,437,499 | A | * | 3/1984 | Devale | 141/95 |
| 4,487,333 | A | * | 12/1984 | Pounder et al. | 222/54 |
| 4,596,558 | A | | 6/1986 | Smith et al. | |
| 4,910,682 | A | | 3/1990 | Wolff et al. | |
| 5,000,357 | A | | 3/1991 | Shannon et al. | |
| 5,058,780 | A | | 10/1991 | Plester et al. | |
| 5,068,586 | A | | 11/1991 | Kawahara | |
| 5,095,710 | A | | 3/1992 | Black et al. | |
| 5,305,923 | A | | 4/1994 | Kirschner et al. | |
| 5,332,123 | A | | 7/1994 | Farber et al. | |
| 5,492,449 | A | * | 2/1996 | Hunklinger et al. | 417/259 |
| 5,700,401 | A | | 12/1997 | Weinberg et al. | |
| 5,725,125 | A | | 3/1998 | Bessette et al. | |
| 5,803,320 | A | | 9/1998 | Cutting et al. | |
| 5,974,950 | A | | 11/1999 | King | |
| 6,117,471 | A | | 9/2000 | King | |
| 6,394,312 | B1 | | 5/2002 | Endou | |
| 6,435,375 | B2 | | 8/2002 | Durham et al. | |
| 6,457,607 | B1 | | 10/2002 | Andrea et al. | |
| 6,506,030 | B1 | | 1/2003 | Kottke et al. | |
| 6,564,971 | B2 | * | 5/2003 | Heyes | 222/129.1 |
| 6,568,565 | B1 | | 5/2003 | Schroeder et al. | |
| 6,811,548 | B2 | | 11/2004 | Jeffery | |
| 2002/0060226 | A1 | | 5/2002 | Kameyama | |
| 2002/0074350 | A1 | | 6/2002 | Jones et al. | |
| 2002/0145008 | A1 | | 10/2002 | Jones et al. | |
| 2004/0056046 | A1 | | 3/2004 | Jones et al. | |
| 2006/0243740 | A1 | | 11/2006 | Renyolds et al. | |

OTHER PUBLICATIONS

Compraelec, Brochure—Waterpumps—The MP 3 Series of Solenoid Pumps, Undated, p. 15, Strasbourg, France.

* cited by examiner

FLUID DISPENSING SYSTEM SUITABLE FOR DISPENSING LIQUID FLAVORINGS

RELATED APPLICATIONS

This application is a continuation of U.S. patent application Ser. No. 10/964,673 filed Oct. 15, 2004, which claims the benefit of U.S. Provisional Patent Application Nos. 60/572,605, filed May 20, 2004 and 60/511,121 filed Oct. 15, 2003, all of which are hereby expressly incorporated by reference herein.

FIELD OF THE INVENTION

The present invention relates to fluid dispensing systems, and more particularly to fluid dispensing systems suitable for dispensing liquid flavorings.

BACKGROUND OF THE INVENTION

Flavored beverages, for example, flavored coffees, are very popular with consumers. In preparing a flavored beverage, it is possible to add the flavor at various stages, including at an earlier stage in the production of the flavored beverage, for example at a bulk production facility, or at a later stage, such as when the flavored beverage is being dispensed to the consumer. In the following description, the focus is on flavored coffee, however similar principles may be applied to the flavoring of other beverages.

As an example of flavoring earlier in the production process, a particular flavor of coffee may be brewed directly from coffee beans that have been treated with a flavoring liquid. This process has the benefit that it is a somewhat cheaper bulk process, however, oils and essences from such flavored coffee beans can leave residual traces of the flavoring compounds in coffee brewing machines and in the containers used to contain the brewed coffee or to store the unbrewed coffee. The residual traces of the flavoring compounds can negatively affect the perceived taste of other flavors of coffee, and of unflavored coffee brewed with the same brewing machines or stored in the same container at a later time.

Accordingly, in order to avoid cross-contamination of different flavors of coffee with one another, it has been known to use separate machines, or at least separate components (e.g. grinders, pots, thermal containers, filter reservoirs, etc.) for a single machine, to brew and store each flavor of coffee. However, this duplication of equipment increases capital costs, and does not take into account human errors that may lead to different pieces of coffee brewing equipment and/or individual machines being used for multiple flavors of coffee. Also, it is in most cases impractical for individual consumers to purchase different coffee-brewing machines (or components) for each flavor of coffee they may want to consume.

As an example of flavoring at a later stage, flavored coffee can also be produced by adding a liquid or powdered flavoring agent to a cup or pot of unflavored coffee. Highly concentrated flavoring compounds are typically very potent, meaning that minute amounts (e.g. on the order of 0.01 ml and sometimes less) may affect the flavor of an 8 oz beverage. Retail coffee vendors or home consumers do not typically have reliable and practical means for measuring out such small amounts of a pure liquid flavoring compound each time a particular flavor of coffee is desired.

Accordingly, concentrated flavoring compounds used to flavor coffee are typically diluted with a suitable carrier, such as ethyl alcohol or propylene glycol. However, ethyl alcohol leads to an intoxicating effect in people when consumed in significant amounts, and also should not be consumed in combination with certain medicines. Furthermore, propylene glycol, in the concentrations commonly used in liquid flavorings, adds an undesirable aftertaste to the flavored coffee or other beverage. It is thus desirable to use as little propylene glycol as possible in a liquid flavoring. In other words, a reduction in the amount of propylene glycol used to dilute a pure flavoring compound to produce a usable liquid flavoring improves the taste of the beverage to which the flavoring liquid is added since the aftertaste associated with the propylene glycol is also reduced.

One factor affecting how concentrated (or dilute) the flavoring liquid can be, in a practical sense for it to be usable in a retail or home environment, is the ability to reliably measure out small volumes of the resulting flavoring liquid. Currently available measuring devices and methods permit retail coffee vendors and home consumers to measure amounts of flavoring liquids that are in the order of several milliliters. Consequently, a typical dose of a commercially available flavoring liquid is on the order of 5 mL, which means that the concentrated flavoring compound has been diluted by a substantial amount of a carrier such as propylene glycol.

Further, particularly in a retail environment, it is important to be able to dispense a consistent amount of flavoring for each cup of coffee produced so that the consumer does not notice any changes in the taste of a particular flavored coffee from time to time. Individual packets of flavoring having the precise amounts needed could be used in such a situation, however, unless a large amount of carrier is used, these packages would be quite small. Further, in a retail environment, individual packages can be time consuming and the individual serving a flavored beverage may not choose the right package for cup size or succeed in placing all of the flavoring from the package directly into the cup, resulting in inconsistencies in the flavoring of a beverage.

As such, there is a need for an improved fluid dispensing system suitable for dispensing liquid flavorings.

SUMMARY OF THE INVENTION

In one embodiment, the present invention relates to a fluid dispensing apparatus. The fluid dispensing apparatus comprises a pulse generator operable to generate discrete pulses, actuating means for actuating the pulse generator, and at least one pump. Each pump is operable in discrete cycles, with each discrete cycle pumping a predetermined volume of fluid. Each pump is operably coupled to the pulse generator so that each discrete pulse received by a particular pump drives that pump to operate through a predetermined number of cycles. Each pump has a fluid inlet connectable in fluid communication to a corresponding fluid reservoir and a fluid outlet connected in fluid communication with a dispensing outlet.

In another embodiment, the present invention is directed toward a fluid dispensing apparatus comprising a pulse generator operable to generate discrete pulses of a first type, actuating means for actuating the pulse generator, and at least one pump. Each pump has an inlet connectable in fluid communication with a corresponding fluid reservoir, an outlet connected in fluid communication with a dispensing outlet, and a pump chamber. Each pump is operable over discrete cycles, with each cycle comprising a first portion in which fluid is drawn through the inlet into the pump chamber, and a second portion in which fluid is expelled from the pump chamber through the outlet. Each discrete cycle pumps a discrete volume of fluid. Each pump is operably coupled to the pulse generator so that each discrete pulse of the first type drives the pump to complete at least part of the second portion of a cycle and thereby expel at least a portion of the discrete volume of fluid. Preferably, the pulse generator is also operable to generate discrete pulses of a second type, and each pump is operably coupled to the pulse generator so that each pulse of the second type drives the pump to complete at least part of the first portion of a cycle. Still more preferably, the pulse generator is operable to first generate a number of pulses of the first type, and to generate a number of pulses of the second type equal to the number of pulses of the first type after generating the pulses of the first type.

For both of the embodiments described above, it is preferred that the predetermined number of cycles is one cycle, and that the pulse generator be a controller. Also preferably, the actuating means comprises means for transmitting signals relating to the volume of fluid to be dispensed, and the controller is operable in response to the signals to adjust the number of discrete pulses generated based on the signals received. Still more preferably, the apparatus of claim 11, also includes at least one sensor operably connected to the controller for sensing a variable associated with a liquid and transmitting a signal associated with the variable to the controller. The controller is operable to vary the number of discrete pulses generated based on the signal provided by the at least one sensor.

According to another embodiment of the invention, there is provided a fluid dispensing apparatus including a fluid reservoir, a dispensing outlet, a pump in fluid communication with the fluid reservoir and the dispensing outlet to pump fluid from the fluid reservoir to the dispensing outlet, a pulse generator for generating a plurality of discrete pulses and coupled to the pump so that each discrete pulse drives the pump to dispense a first predetermined amount of fluid, and a controller coupled with the pulse generator and controlling the pulse generator such that a second predetermined amount of fluid is dispensed during an operation of the fluid dispensing apparatus. In particular, the first predetermined amount of fluid is preferably less than approximately 0.1 ml and the second predetermined amount of fluid is preferably less than approximately 0.5 ml.

In one particular case, the pump is operable in discrete cycles, each cycle comprising a first portion in which fluid is drawn into a pump chamber from the reservoir, and a second portion in which fluid is expelled from the pump chamber to the dispensing outlet and wherein each discrete pulse of the pulse generator drives the pump through a complete cycle to dispense the first predetermined amount of fluid.

In another particular case, the pump is operable in cycles, each cycle comprising a first portion in which fluid is drawn into a pump chamber from the reservoir, and a second portion in which fluid is expelled from the pump chamber to the dispensing outlet and wherein each discrete pulse of the pulse generator drives the pump through a part of the first portion or the second portion of the cycle to dispense the first predetermined amount of fluid and the controller controls the pulse generator such that sufficient pulses are delivered to dispense the second predetermined amount.

In this embodiment, the fluid dispensing apparatus may include sensors to detect a characteristic of the fluid, the presence or size of a receptacle for receiving fluid, whether or not the fluid reservoir is empty or the like and the controller may control the operation of the fluid dispensing device based on information sensed by these sensors.

According to another embodiment of the invention, there is provided a method of detecting when a fluid reservoir in a fluid dispensing apparatus having a pump is empty, the method including detecting a sound produced by the pump, comparing the detected sound produced by the pump to a predetermined sound of the pump; and determining if the fluid reservoir is empty based on the comparison. Preferably, this method further includes indicating to a user that the fluid reservoir may be empty.

In a particular case, the predetermined sound comprises a sound of the pump when empty and the determining comprises filter matching of the detected sound with the predetermined sound.

Preferably, the detecting is performed a plurality of times during each operation of the pump and the detecting and comparing are performed over a plurality of operations of the fluid dispensing apparatus before determining that the fluid reservoir is empty.

DETAILED DESCRIPTION OF THE INVENTION

The following provides a description of the types of pumps which may be used for liquid flavoring dispensing and continues with a description of various examples of fluid dispensing systems suitable for dispensing liquid flavoring.

Pumps may generally be classified into two basic types: continuous flow pumps, and reciprocating pumps.

A continuous flow pump is a pump that is by its nature able to maintain a continuous flow of fluid. Such pumps generally rely on some form of continuously rotating impeller. Examples of continuous flow pumps include turbine pumps, propeller pumps, and the Archimedes screw.

A reciprocating pump is a pump that operates in individual discrete cycles, with each cycle moving a discrete, consistent volume of fluid. As its name suggests, a reciprocating pump will have a member that reciprocates between two positions. As the member moves from the first position to the second position, it draws a discrete volume of fluid into a pump chamber through an inlet from a fluid source. As the member moves from the second position back to the first position, it drives the fluid from the pump chamber through an outlet. One-way valves are used to prevent fluid from being forced back into the inlet, and to prevent expelled fluid from being drawn back into the chamber through the outlet. Examples of reciprocating pumps include piston pumps and diaphragm pumps.

Figure 1B:
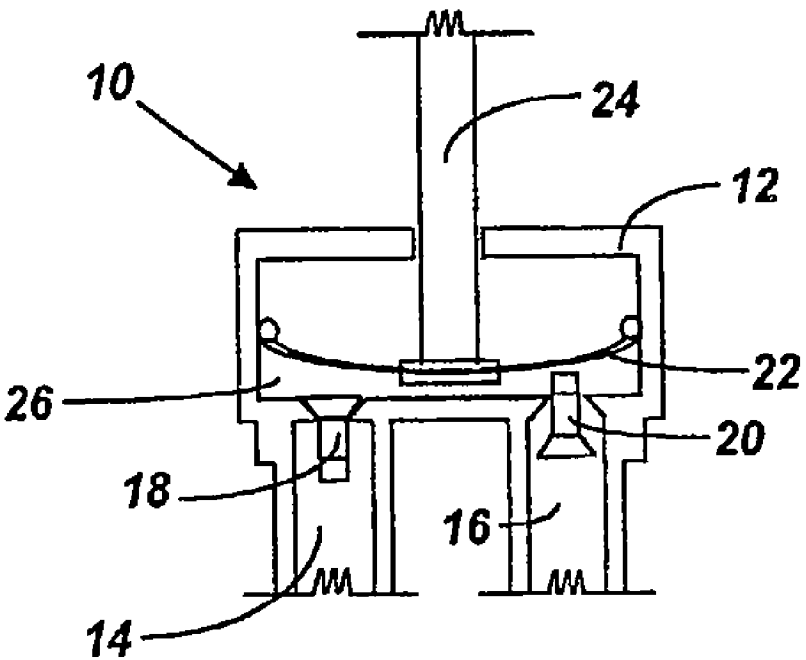
Figure 1b (PRIOR ART)
FIG. 1*b* is a cross sectional view of a prior art diaphragm pump with its diaphragm in a second position.
Figure 1A:
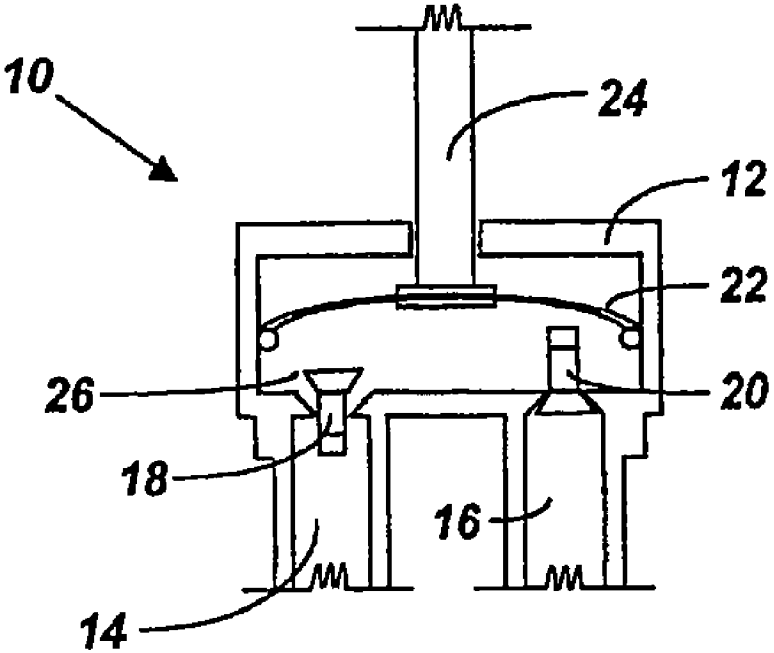
Figure 1a (PRIOR ART)
FIG. 1*a* is a cross sectional view of a prior art diaphragm pump with its diaphragm in a first position.

Referring to FIGS. 1*a* and 1*b*, a diaphragm pump 10 is shown in cross section. The diaphragm pump 10 has a housing 12 having an inlet 14 and an outlet 16. One-way valves 18 and 20 are positioned in the inlet 14 and outlet 16, respectively, and a pump chamber 26 is defined by the internal walls of the housing 12. A flexible diaphragm 22 is secured to the interior side walls of the housing 12 within the pump chamber 26, and is driven between a first position and a second position by a shaft 24. Specifically, FIG. 1*a* shows the diaphragm pump 10 with the diaphragm 22 in a first position, and FIG. 1*b* shows the diaphragm pump 10 with the diaphragm 22 in a second position.

Assuming that the pump 10 has already been primed, when the diaphragm 22 is in the first position (FIG. 1*a*) there will be a specific volume of fluid contained within the pump chamber 26. As the shaft 24 drives the diaphragm 22 into the second position (FIG. 1*b*), the volume of the pump chamber 26 is reduced, driving fluid out of the pump chamber 26 through the outlet 16. The one-way valve 18 prevents fluid from being driven out of the inlet 14. As can be seen, the volume of the pump chamber 26 will be reduced by a certain volume as the diaphragm 22 moves from the first position to the second position. This reduction in volume corresponds to the volume of fluid expelled from the diaphragm pump 10 on each cycle.

As the shaft 24 pulls the diaphragm 22 from the second position (FIG. 1*b*) to the first position (FIG. 1*a*), the volume of the pump chamber 26 will be increased by the same volume by which it was reduced earlier in the cycle. This results in a suction effect, drawing fluid into the pump chamber 26 through the inlet 14. The one-way valve 20 prevents expelled fluid from being drawn back into the pump chamber 26 through the outlet 16. Again, the volume of fluid drawn into the pump chamber 26 will correspond to amount by which the volume of the pump chamber 26 has been increased.

Once the diaphragm 22 has returned to the first position (FIG. 1*a*) so that the volume of fluid in the pump chamber 26 has been recharged, the diaphragm 22 can again be moved to the second position (FIG. 1*b*). This will again expel a volume of fluid corresponding to the reduction in volume of the pump chamber 26. Thus, the diaphragm pump 10 can consistently pump a discrete volume of fluid on each cycle.

Figure 2B:
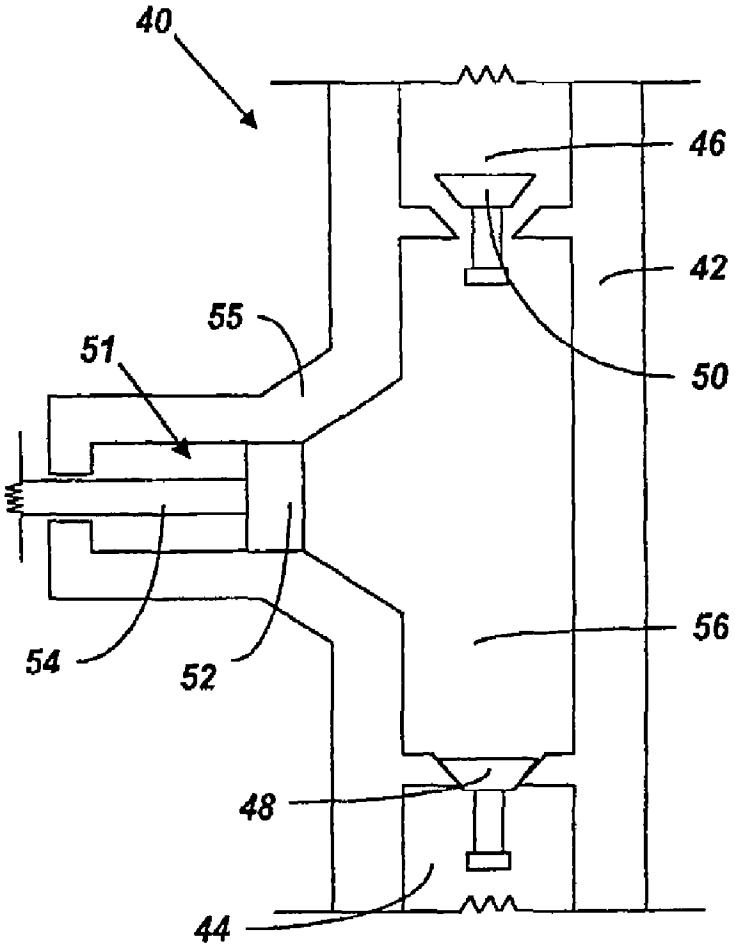
Figure 2b (PRIOR ART)
FIG. 2*b* is a cross sectional view of a prior art piston pump with its piston in a second position.
Figure 2A:
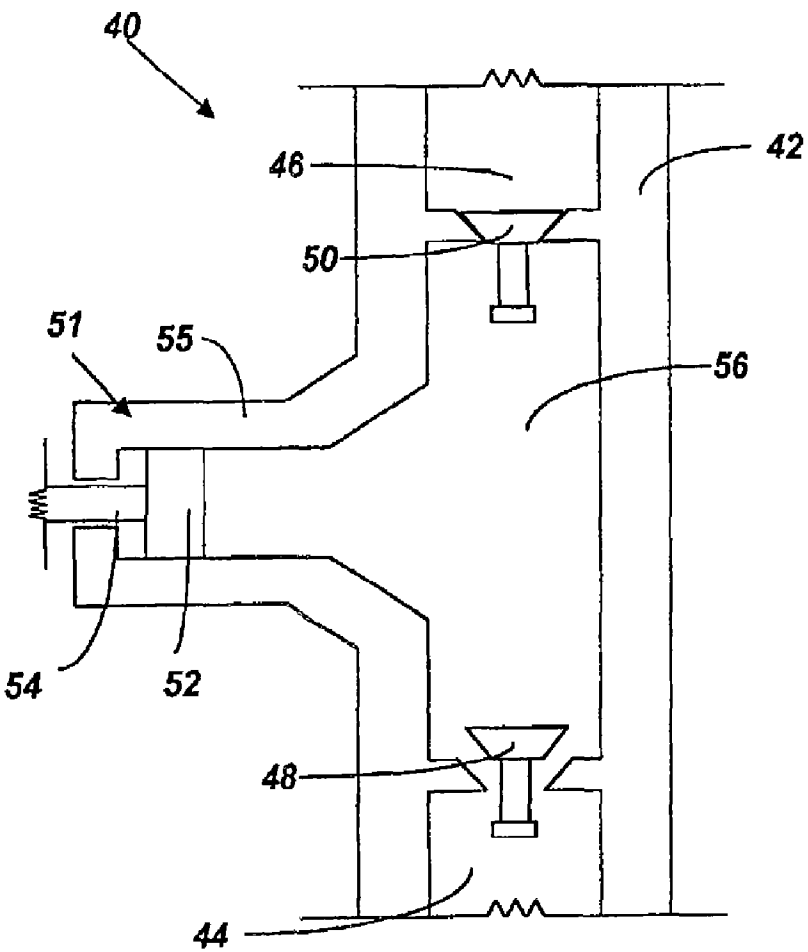
Figure 2a (PRIOR ART)
FIG. 2*a* is a cross sectional view of a prior art piston pump with its piston in a first position.

A piston pump 40 is shown in cross section in FIGS. 2*a* and 2*b*. The piston pump 40 operates on a similar principle to that of the diaphragm pump 10, and comprises a housing 42 having an inlet 44 and an outlet 46. One-way valves 48 and 50 are positioned in the inlet 44 and outlet 46, respectively. A piston 51 comprising a piston head 52 and a piston shaft 54 is slidably received within a piston chamber portion 55 of the pump chamber 56 defined by the internal walls of the housing 42. The piston head 52 substantially sealingly engages the interior wall of the piston chamber portion 55. One skilled in the art will appreciate that some very small degree of leakage may occur between the piston head 52 and the interior wall of the piston chamber portion 55 if the piston head 52 is to slide therewithin. However, such leakage should not be large enough to affect the accuracy of the piston pump 40.

In operation, the piston 51 reciprocates between the first position, shown in FIG. 2*a*, and the second position, shown in FIG. 2*b*. Assuming that the piston pump 40 has been primed, a volume of fluid will be contained within the pump chamber 56. As the piston 51 moves from the first position to the second position, the piston head 52 slides along the interior wall of the piston chamber portion 55, thereby reducing the overall volume of the pump chamber 56. This causes a corresponding volume of fluid to be expelled from the pump chamber 56 through the outlet 46. The one-way valve 48 prevents fluid from being forced back into the inlet 44.

As the piston 51 moves from the second position back to the first position, the volume of the pump chamber 56 will increase, resulting in a suction effect that draws fluid through the inlet 44 into the pump chamber 56. The one-way valve 50 prevents fluid from being drawn back into the pump chamber 56 from the outlet 48.

Once the piston 51 has returned to the first position (FIG. 2*a*) the volume of fluid in the pump chamber 56 will have been recharged. The piston 51 can then be moved back into the second position (FIG. 2*b*), again expelling a volume of fluid corresponding to the reduction in volume of the pump chamber 56. Thus, like the diaphragm pump 10, the piston pump 40 can consistently pump a discrete volume of fluid on each cycle.

The source of motive force for the shaft 24 or piston 51 may be a solenoid, or flywheel driven by a stepping motor, or some other source of motive force permitting the pump 10 or 40 to be controllably operated one cycle at a time.

It will be appreciated that the diaphragm pump 10 and the piston pump 40 are provided as examples only, and that other reciprocating pumps are also available.

One skilled in the art will also appreciate that although a reciprocating pump can be made to operate in a substantially continuous manner by driving it to continuously repeat its cycles at a high rate of cycles per unit time, this does not change the fundamental nature of the pump. No matter how high the number of cycles per unit time, a reciprocating pump nonetheless operates in distinct cycles, each cycle pumping a consistent, discrete volume of fluid.

One useful version of a reciprocating pump is a modified reciprocating pump in which the portion of the cycle during which fluid is expelled is divided into sub-cycles. Now referring to FIGS. 3*a* to 3*d*, a modified version of a piston pump, which may also be referred to as a modified syringe pump or modified infusion pump, is shown generally at 70.

The modified infusion pump 70 has a housing 72, an inlet 74, and an outlet 76. One-way valves 78, 80 are positioned in the inlet 74 and outlet 76, respectively. A piston 81 comprising a piston head 82 and a shaft 84 is slidably received within a pump chamber 86 defined by the housing 72. The piston head 82 substantially sealingly engages the interior wall of the pump chamber 86 defined by the housing 72. As with the piston pump 40, it is understood that some small amount of leakage may occur, although not in amounts that will affect the accuracy of the pump 70.

Figure 3B:
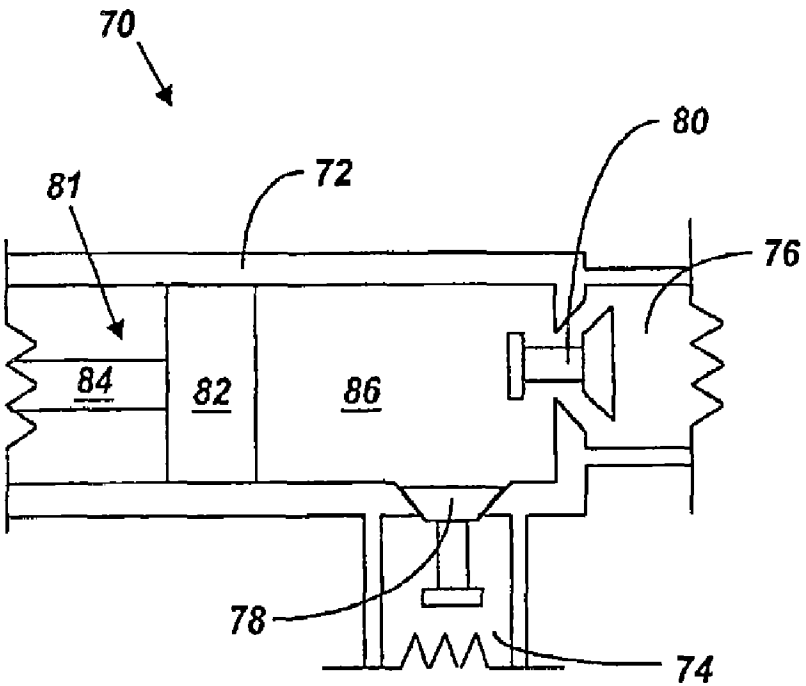
FIG. 3*b* is a cross sectional view of a modified infusion pump with its piston having advanced incrementally from a retracted position.
Figure 3A:
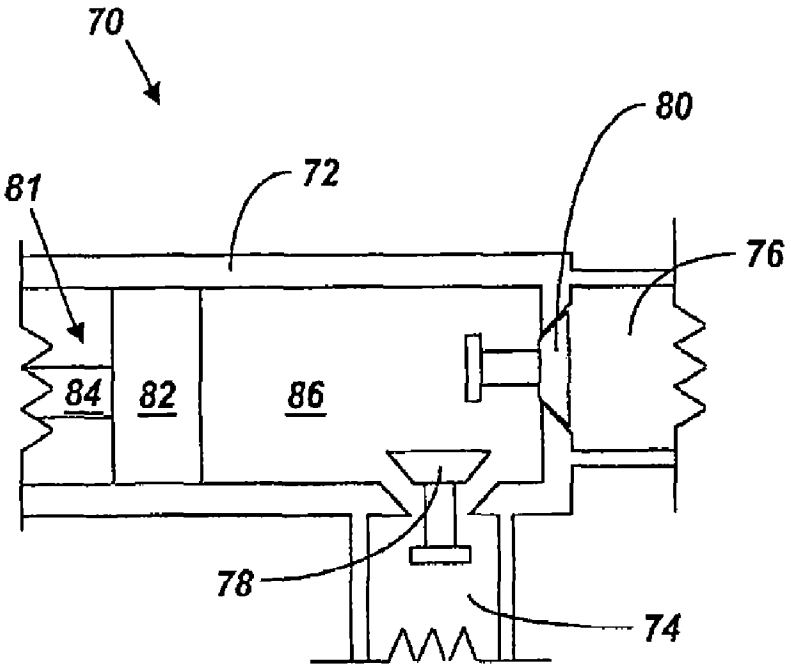
FIG. 3*a* is a cross sectional view of a modified infusion pump with its piston in a retracted position.
Figures 3C, 3D:
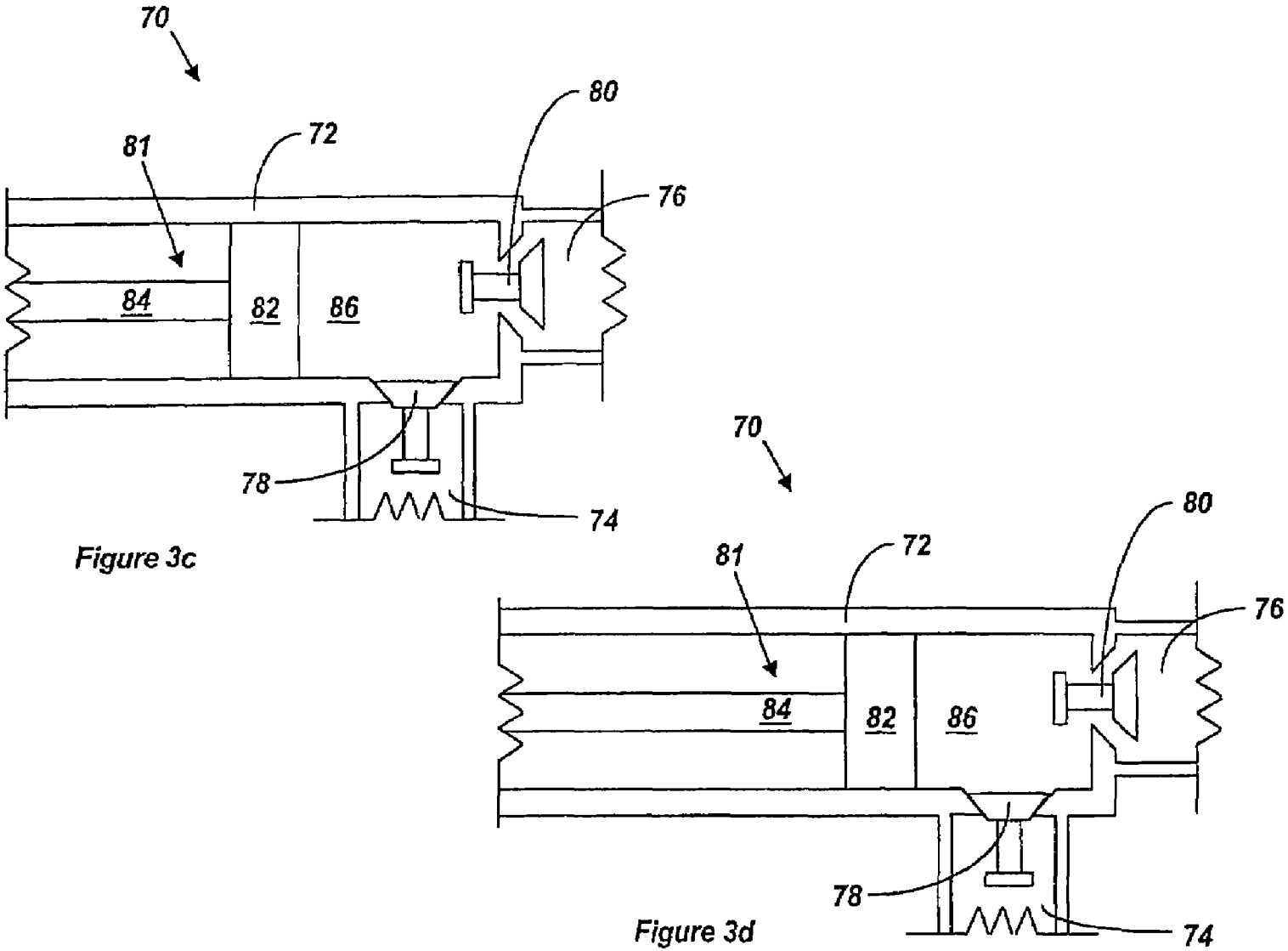
FIG. 3*c* is a cross sectional view of a modified infusion pump with its piston having advanced incrementally from the incremented position in FIG. 3*b;*
FIG. 3*d* is a cross sectional view of a modified infusion pump with its piston in a fully extended position.

Referring now specifically to FIG. 3*a*, the modified infusion pump 70 is shown with the piston 81 in a first position, i.e. the piston 81 is fully retracted so that the volume of the pump chamber 86 is at a maximum. If the modified infusion pump 70 has been primed, then the interior volume of the pump chamber 86 will be filled with fluid. With reference now to FIG. 3*d*, the modified infusion pump 70 is shown with the piston 51 in a second position, i.e. the piston 81 is in a fully extended position so that the volume of the pump chamber 86 is at a minimum. As the piston 81 moves from the fully retracted position shown in FIG. 3*a* through the positions shown in FIGS. 3*b* and 3*c* to the fully extended position shown in FIG. 3*d*, a discrete volume of fluid will be expelled through the outlet 76. The one-way valve 78 prevents fluid from being forced into the inlet 74. Then, as the piston moves from the second position shown in FIG. 3*d* back to the first position shown in FIG. 3*a*, fluid will be drawn into the pump chamber 86 through the inlet 74. The one-way valve 80 prevents expelled fluid from being drawn back into the pump chamber 86 through the outlet 86. Thus, the modified infusion pump 70 is able to expel a discrete volume of fluid as the piston 81 moves from its first position (FIG. 3*a*) to its second position (FIG. 3*d*).

Because each cycle pumps a discrete, substantially consistent volume of fluid, the volume of fluid dispensed can be controlled with substantial precision simply by controlling the number of cycles over which the pump is operated. For example, if the pump 70 operates at a rate of 0.01 cubic centimeters (cc) per cycle, then a volume representing any multiple of 0.01 cc can be dispensed by operating the pump over that multiple of cycles. For example, a volume of 0.24 cc could be dispensed by operating the pump 70 over 24 cycles, and a volume of 0.36 cc could be dispensed by operating the pump over 36 cycles.

Figure 4:
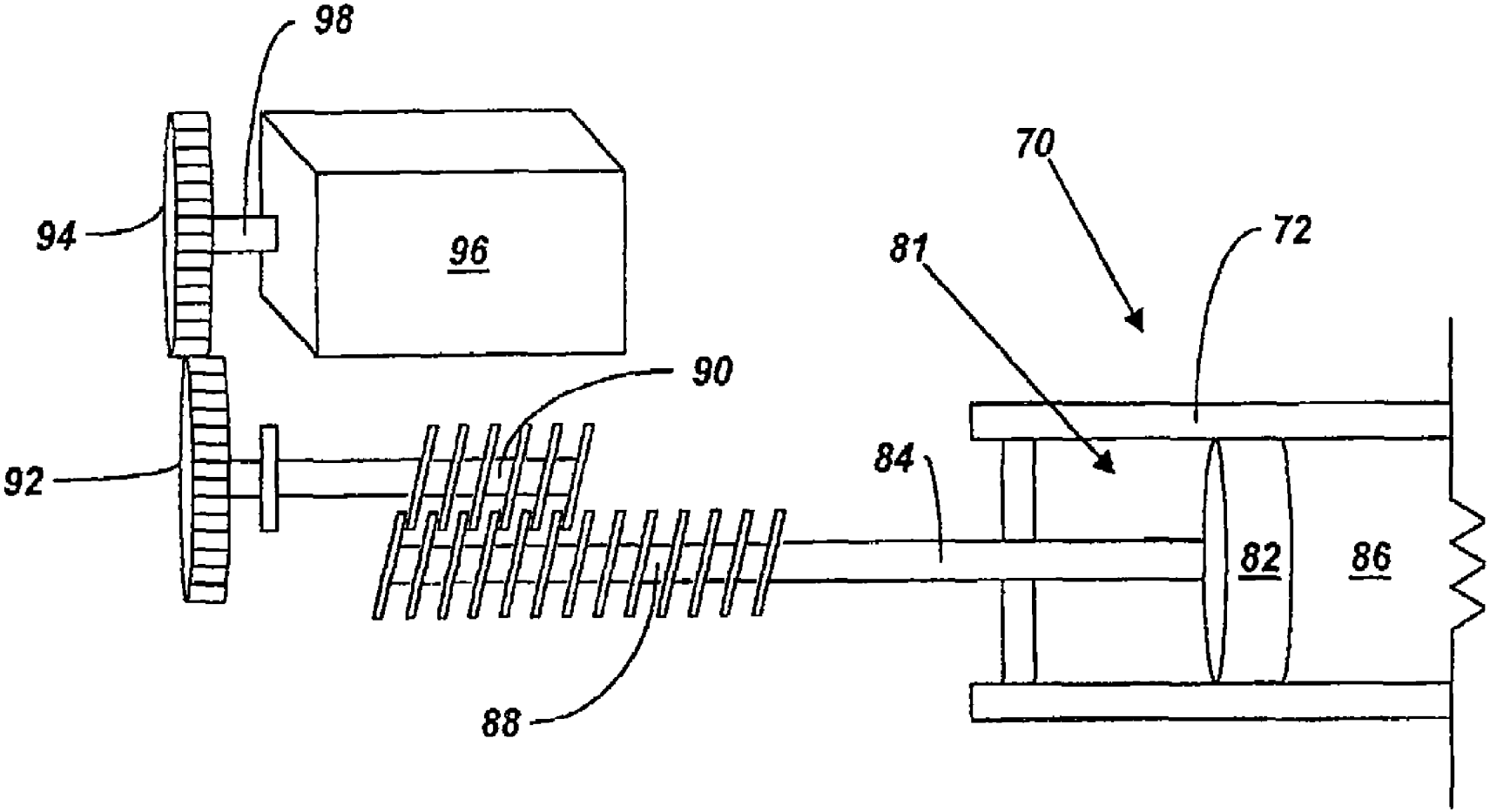
FIG. 4 is a cut-away view of a portion of a first drive mechanism for a modified infusion pump.

Now referring to FIG. 4, in another version of the modified infusion pump 70, at least a portion 88 of the shaft 84 of the piston 81 is threaded. The threaded portion 88 of the shaft 84 meshes with a threaded rod 90. The threaded rod 90 is driven by a first gear 92, which meshes with and is driven by a second gear 94. The second gear 94 is driven by a stepping motor 96 having a drive shaft 98. Thus, when the stepping motor 96 is actuated to drive the drive shaft 98, the drive shaft 98 drives the second gear 94, the second gear 94 drives the first gear 92, which in turn drives the threaded rod 90 to rotate. Because the threaded rod 90 meshes with the threaded portion 88 of the shaft 84, rotation of the threaded rod 90 causes the shaft 84, and therefore the piston 81, to either advance or retract relative to the pump chamber 86. Whether the piston 81 advances or retracts will depend on the direction of rotation of the drive shaft 98.

Through the use of a stepping motor and precise gearing among the gears 92, 94 and the threaded rod 90, it is possible to advance the piston 81 incrementally into the pump chamber 86. In particular, a single complete revolution of the drive shaft 98 would result in the piston 81 moving a discrete distance into the pump chamber 86, as shown in FIG. 3*b*, although not all the way into the second position shown in FIG. 3*d*. This discrete movement will result in a discrete reduction in the volume of the pump chamber 86, in turn resulting in a discrete volume of fluid being expelled through the outlet 76. Moving the drive shaft 98 through another complete revolution will cause the piston 81 to advance further into the pump chamber 86 by the same discrete distance, as shown in FIG. 3*c*, resulting in the same discrete volume of fluid being expelled through the outlet 76. By selecting the appropriate gearing, the piston 81 can be made to advance into the pump chamber 86 by any desired distance upon a complete revolution of the drive shaft 98 of the stepping motor 96.

The modified infusion pump 70 permits various volumes of fluid to be selectively dispensed. For example, in a particular embodiment of the modified infusion pump 70, upon each revolution of the drive shaft 98, the piston 81 may advance into the pump chamber 86 by a distance corresponding to the expulsion of 0.01 cc of fluid through the outlet 76. It is then possible to dispense volumes of fluid in multiples of 0.01 cc by controlling the number of revolutions of the drive shaft 98. Moving the drive shaft 98 through 24 complete revolutions will advance the piston 81 the appropriate distance to expel 0.24 cc of fluid through the outlet 76.

In the modified infusion pump 70, after the desired quantity of fluid has been expelled, the piston 81 would then be retracted back to the first position as shown in FIG. 3*a*. This would increase the volume of the pump chamber 86 and create a suction effect to draw fluid into the pump chamber 86 through the inlet 74, thereby refilling the pump chamber 86. The one-way valve 80 would prevent expelled fluid from being drawn back into the pump chamber 86 through the outlet 76. Retraction of the piston 81 could be achieved by rotating the drive shaft 98 in the opposite direction to that used to advance the piston 81, for the same number of rotations.

One skilled in the art will appreciate that the discrete advances of the piston 81 into the pump chamber 86 need not be tied to a complete revolution of the drive shaft 98. If the stepper motor 96 is sufficiently accurate, each discrete advance of the piston 81 into the pump chamber 86 may be achieved by a fraction of a complete revolution of the drive shaft 98.

Figure 5:
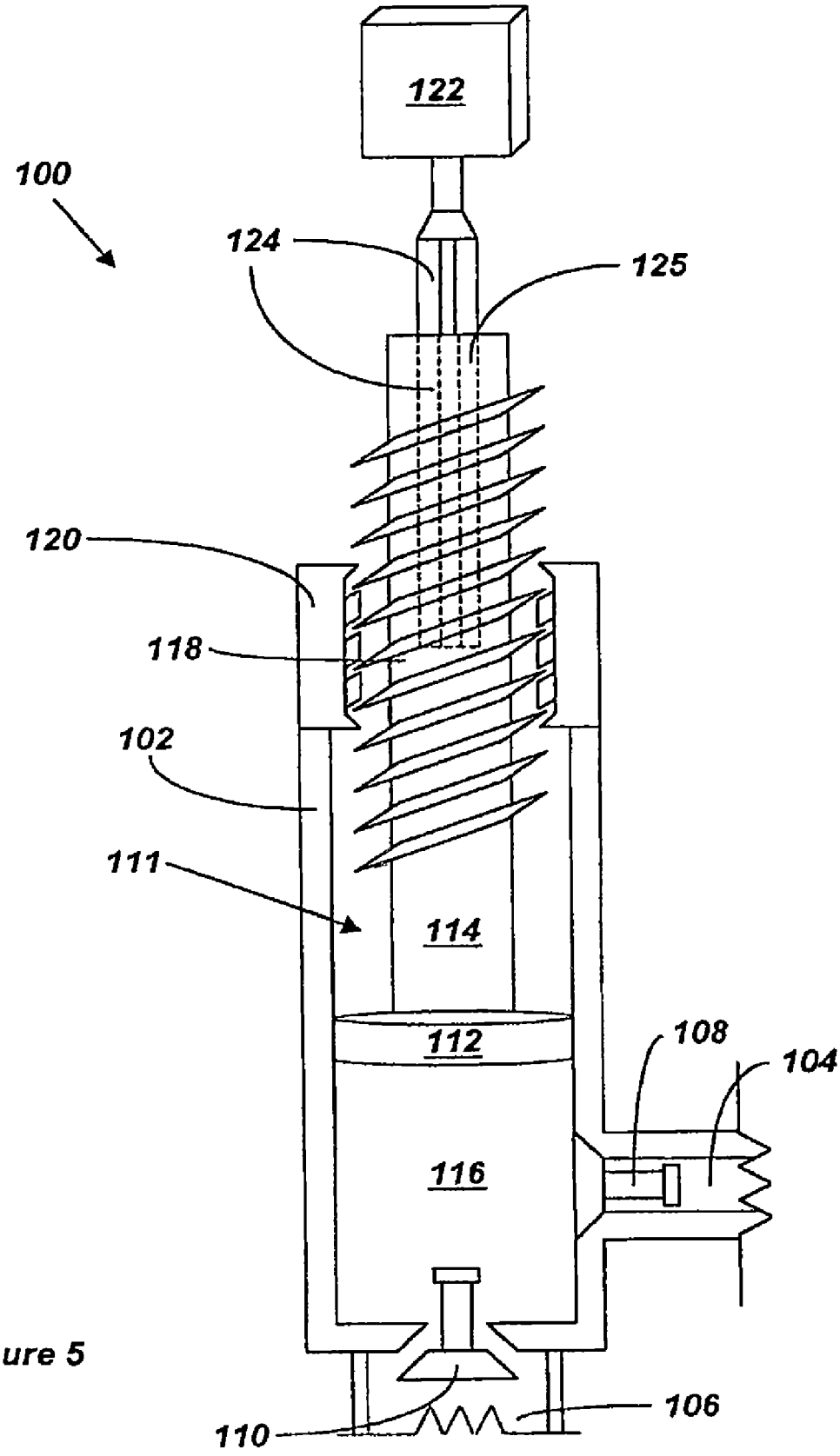
FIG. 5 is a cut-away view of a portion of a second drive mechanism for a modified infusion pump.

With reference now to FIG. 5, a gearing mechanism for an alternate embodiment of a modified infusion pump 100 is shown. The modified infusion pump 100 comprises a housing 102, an inlet 104 and an outlet 106. A one way valve 108 is positioned in the inlet 104, and a one-way valve 110 is positioned in the outlet 108. A piston 111 comprising a piston head 112 and a shaft 114 is slidably received within a pump chamber 116 defined by the interior walls of the housing 102. The piston head 112 substantially sealingly engages the inner wall of the pump chamber 116. Again, although minor leakage may occur, such leakage should not affect the accuracy of the pump 100.

A portion 118 of the shaft 114 is threaded. This threaded portion 118 meshes with a threaded collar 120, which may form part of the housing 102. A stepper motor 122 drives a drive shaft 124, which extends into an axial cavity 125 (shown by dashed lines) in the shaft 114 to drive the shaft 114 to rotate. As the shaft 114 rotates, the meshing of the threaded portion 118 with the threaded collar 120 causes the shaft 114, and therefore the piston 111, to advance axially into the pump chamber 116. This results in a reduction of the volume of the pump chamber 116, causing fluid contained within the pump chamber 116 to be expelled through the outlet 106. The one-way valve 108 prevents fluid from being expelled through the inlet 104. The use of calibrated threading on the threaded portion 118 of the shaft 114, and on the threaded collar 120, permits the distance of linear advancement of the piston 111 to be correlated to the revolutions of the drive shaft 124. Thus, one complete revolution of the drive shaft 124 corresponds to advancement of the piston 111 by a given distance, which in turn results in the displacement of a given volume of fluid.

The volume of fluid being displaced can thereby be controlled by controlling the number of revolutions, or fractions of revolutions, of the drive shaft 124.

In a manner similar to that described for the modified infusion pump 70, after the desired volume of fluid has been displaced, the pump chamber 116 can be recharged by driving the stepping motor 122 in a reverse direction until the piston 111 has been completely retracted. This will increase the volume of the pump chamber 116, resulting in a suction effect that will draw fluid into the pump chamber through the inlet 104, thereby refilling the pump chamber. Fluid that has been expelled will not be drawn back into the pump chamber 116 through the outlet 106 because of the one-way valve 110.

Because the piston 111, and therefore the shaft 114, advance and retract axially relative to the housing 102, the drive shaft 124 cannot be fixedly secured within the axial cavity 125 on the shaft 114, as this would interfere with axial movement of the piston 111. For this reason, the drive shaft 124 is slidably received within the axial cavity 125, thereby permitting the shaft 114, and therefore the piston 111, to move axially relative to the drive shaft 124 and stepper motor 122. The drive shaft 124 has a shape permitting it to interlock with the correspondingly shaped axial cavity 125 so that it can drive the shaft 114 rotationally even as the shaft 114 slides axially relative to the drive shaft 124. In the particular embodiment shown, both the drive shaft 124 and the axial cavity 125 have a cross shape. One skilled in the art will appreciate that any appropriate shape may be used, so long as it permits the shaft 114 to be rotationally driven by the drive shaft 124 while sliding axially relative to the drive shaft 124.

Fluid Dispensing System Incorporating "Discrete Volume" Pumps

Simple reciprocating pumps, including but not limited to the diaphragm pump 10 and the piston pump 40, as well as incrementally operable reciprocating pumps in which the fluid expulsion portion of the primary cycle has been broken down into smaller discrete fluid expulsion sub-cycles, including but not limited to the modified infusion pumps 70 and 100, are all referred to herein as "discrete volume" pumps. This is because these types of pumps are all operable to dispense a discrete volume of fluid in response to a pulse. Preferably, the pulse is an electrical signal pulse.

By using a fluid dispensing system that incorporates a discrete volume pump, it is possible to accurately dispense small volumes of fluid in a consistently repeatable manner.

Figure 6:
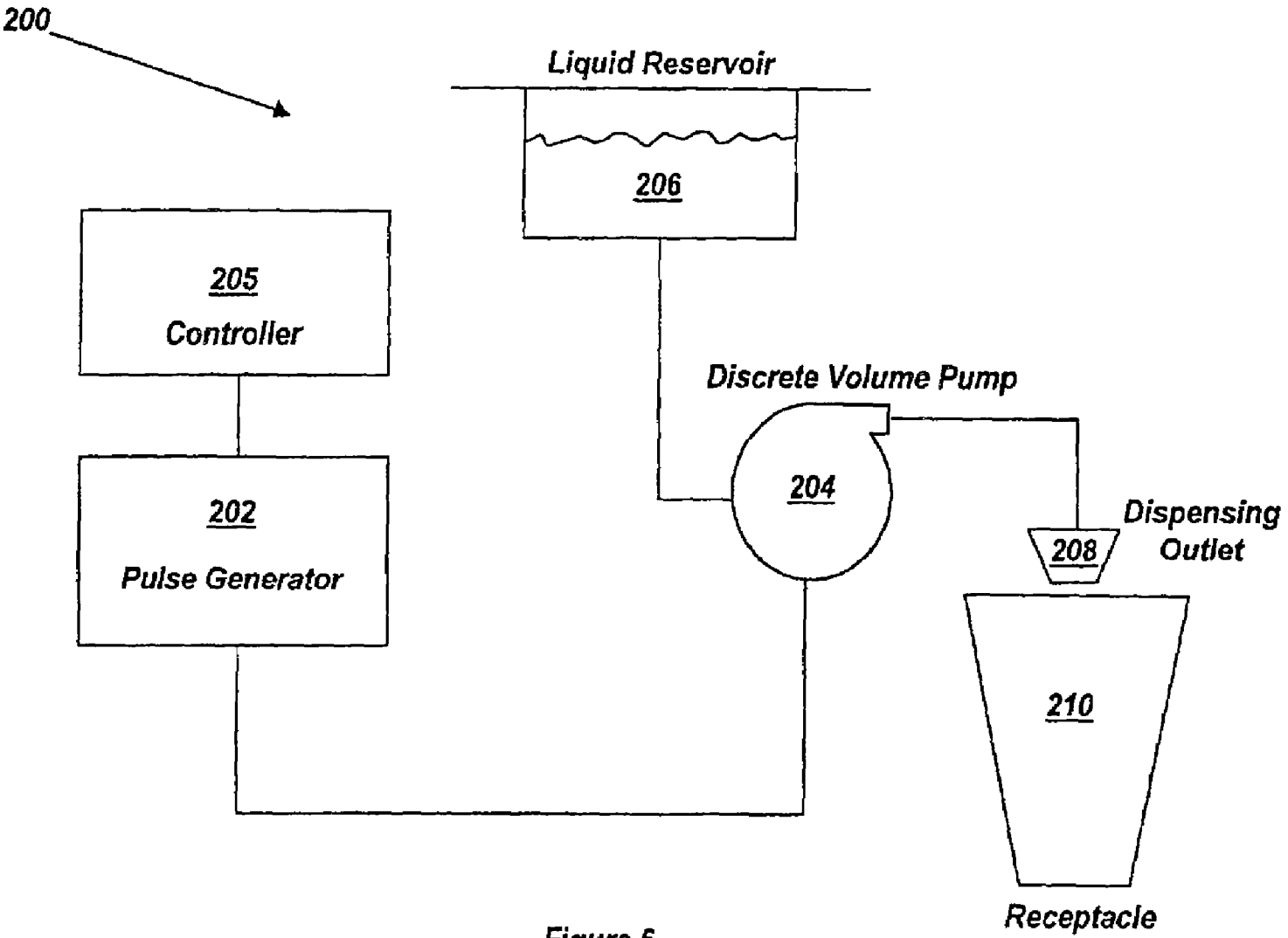
FIG. 6 is a schematic diagram of a fluid dispensing system according to an embodiment of the invention.

Reference is now made to FIG. 6, which is a schematic diagram of the basic elements of an example of a fluid dispensing system 200 in accordance with a preferred embodiment of the present invention. A pulse generator 202 is operably coupled to a discrete volume pump 204. The pulse generator 202 is optionally controlled by a controller 205. In the case of a simple reciprocating pump, pulses generated by the pulse generator 202 would drive the discrete volume pump 204 to operate through a discrete number of cycles. In the case of an incrementally operable discrete volume pump, such as the modified infusion pumps 70, 100, each pulse would drive the discrete volume pump 204 to operate through a discrete number of sub-cycles. Each sub-cycle would be part of the portion of the cycle during which fluid is expelled from the discrete volume pump 204. The pulse generator 202 and controller 205 are described in greater detail below.

The discrete volume pump 204 has an inlet (not shown) connectable, and in this case connected, in fluid communication with a liquid reservoir 206. The discrete volume pump 204 has an outlet (not shown) in fluid communication with a dispensing outlet 208. A receptacle 210 may be positioned to receive fluid dispensed from the dispensing outlet 208.

The fluid dispensing system 200 of the present invention operates as follows. The discrete volume pump 204 and connecting tubing (not shown) are first primed. The pulse generator 202 then generates a pulse that drives the discrete volume pump 204 to operate over a preset number of cycles or sub-cycles. Typically, the discrete volume pump 204 will operate over one cycle or sub-cycle in response to a single pulse.

For a simple discrete volume pump 204 (e.g. the diaphragm pump 10 or the piston pump 40), as the discrete volume pump 204 operates through the preset number of cycles, it will draw a predetermined volume of fluid out of the reservoir 206 and pump an equal volume of fluid through the dispensing outlet 208. For an incrementally operable discrete volume pump 204 (e.g. the modified infusion pumps 70, 100), the discrete volume pump 204 would simply dispense a predetermined volume of fluid from within its pump chamber. After the fluid has been dispensed, a number of pulses of a second type might be provided by the pulse generator 202 to drive the incrementally operable discrete volume pump 204 to return to its "home" position (e.g. with its piston fully retracted) and thereby recharge its pump chamber. Preferably, the number of pulses of the second type will be equal to the number of pulses initially provided, so that the incrementally operable discrete volume pump 204 will increment toward its "home" position by the same number of increments by which it was initially incremented away from its "home" position.

Regardless of whether a simple or incrementally operable discrete volume pump 204 is used, the volume of fluid dispensed may be varied by varying the number of pulses provided to the discrete volume pump 204 by the pulse generator 202. Thus, if a fluid dispenser 200 is used to dispense liquid flavoring into a beverage, the volume of liquid flavoring dispensed could be varied depending on the size of the beverage being flavored.

One skilled in the art will appreciate that the terms "pulse" and "pulse generator" are used in their broadest possible sense. Thus, the pulse generator 202 may be an electronic pulse generator that transmits electrical pulses, or it may be a mechanical pulse generator providing discrete mechanical "pulses".

For example, a hand crank (not shown) that makes a clicking noise after each complete revolution may be mechanically coupled to the discrete volume pump 204 so that one revolution of the hand crank drives the discrete volume pump 204 through one complete cycle or sub-cycle. By counting the number of clicks, a user would be able to control the number of cycles or sub-cycles executed by the discrete volume pump 204, and thereby control the total volume of fluid dispensed. In the case of an incrementally operable discrete volume pump 204, such a hand crank could be configured so that driving it in a in a first direction would drive the discrete volume pump through at least one sub-cycle. Driving the hand crank in a second direction would return the discrete volume pump 204 to its "home" position and thereby recharge the pump chamber.

Although a mechanical pulse generator may be used in the fluid dispenser 200, it is more preferred that an electronic pulse generator be used. Most preferably, the pulse generator is integrated with a controller, as will be described in greater detail below. This permits various types of control features to be integrated into the fluid dispensing system 200 to control the number of pulses in response to different variables. For example, if the fluid dispensing system 200 is used to dispense liquid flavoring into a beverage, when the viscosity of a liquid flavoring being dispensed changes, for example as the temperature changes, a greater or lesser volume of liquid flavoring will be required to achieve the same flavoring effect. Similarly, different liquid flavorings may each have a different viscosity at a particular temperature, so a different number of cycles or sub-cycles may be required for different types of flavors. The use of a controller as the pulse generator 202 allows these variables to be taken into account.

The pump 204 may be coupled to a power source (not shown), with each pulse transmitted from the pulse generator 202 causing the pump to draw power from the power source and execute a preset number of cycles or sub-cycles.

Alternatively, the controller may be operable to selectively permit and prevent the transmission of discrete electrical pulses, for example in the form of a square wave, from a power source, such as 60 Hz AC power, to the discrete volume pump 204. In this case, the power source (as controlled by the controller) can be considered the pulse generator. The electrical pulses supplied to the pump 204 may provide the source of motive power to the pump 204, so that the pulse provides the power needed for the pump 204 to execute one or more cycles. For example, the duration of the pulse (and therefore the time period during which power is supplied to the pump 204) may be made longer than the time period required to execute the preset number of cycles or sub-cycles. This will prevent the pump 204 from stopping mid-cycle due to a lack of power. The pump 204 may be configured with switching means to prevent the pump 204 from executing additional cycles or sub-cycles beyond the preset number, even while power is still being applied, until the power applied has dropped to zero (i.e. the first pulse has ended) and risen again (i.e. the next pulse has begun).

One particular advantageous application of a fluid dispensing system according to aspects of the present invention is as a liquid flavoring dispenser.

First Example of a Liquid Flavoring Dispenser

Figure 7:
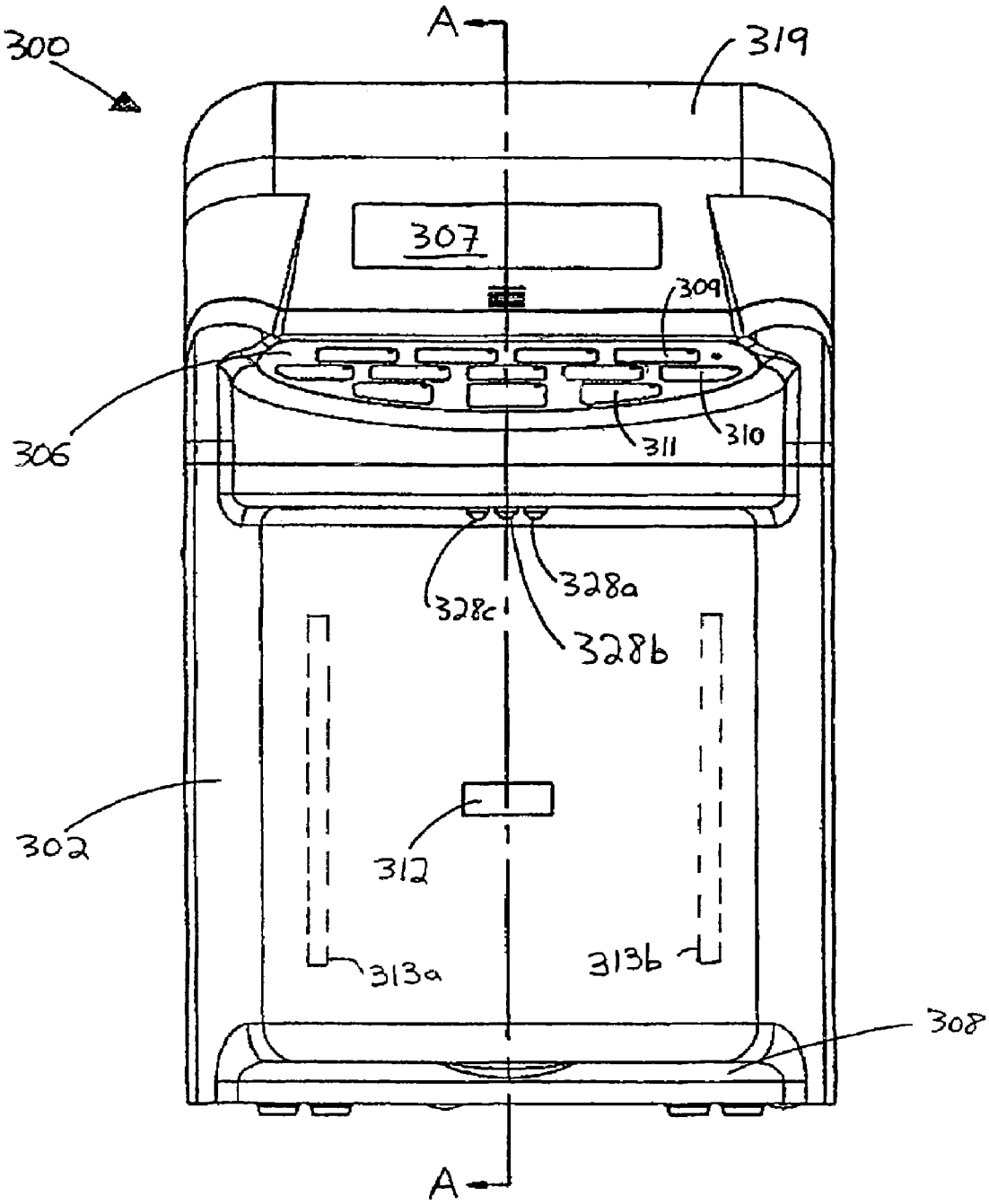
FIG. 7 is a front view of a fluid dispensing system according to another embodiment of the invention.
Figure 8:
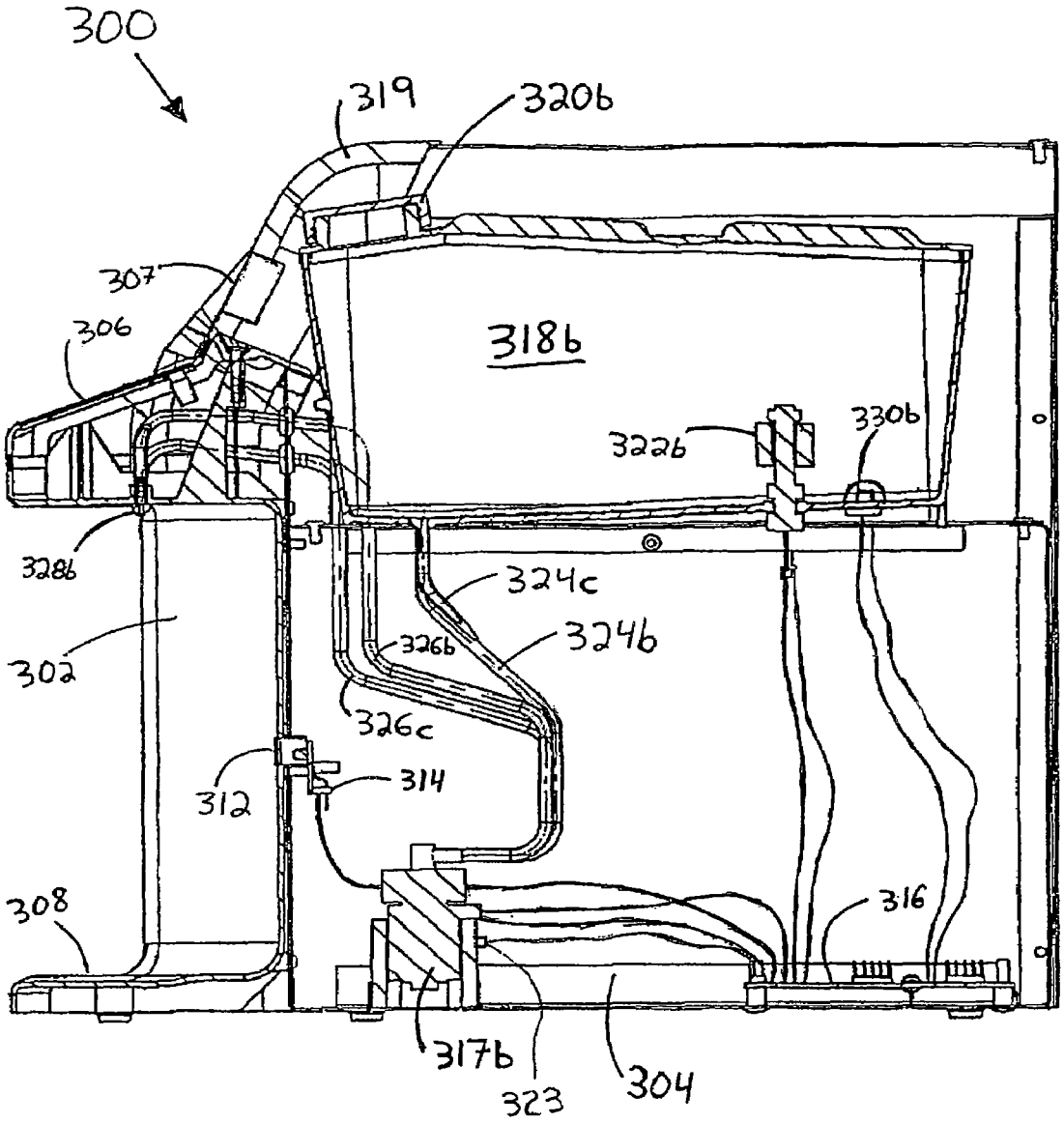
FIG. 8 is a cross sectional view of the fluid dispensing system of FIG. 7, taken along the line A-A.

Now referring to FIGS. 7, 8, 9 and 10, a first example of a liquid flavoring dispenser 300 is shown. FIG. 7 shows a front view of the dispenser 300, and FIG. 8 shows a side cross sectional view. The liquid flavoring dispenser 300 comprises a front housing 302 and a rear housing 304. The front housing 302 has a keypad 306, a display 307 and a cup support 308. The cup support 308 may optionally include a removable drip tray (not shown). The keypad 306 has a plurality of drink selection keys 309, a plurality of size selection keys 310, and a plurality of flavor selection keys 311.

One skilled in the art will appreciate that the display 307 may be an LCD display, or any other suitable electronic display, and will also appreciate that the display 307 is optional, and may be omitted if desired. In addition, the keys 309, 310 and 311 may be provided with associated light emitting diodes (LEDs) to indicate when a particular key 309, 310, 311 has been depressed. It will be apparent to one skilled in the art that if such LEDs are provided, they may also be used as an alternative to the display 307. For example, different patterns of flashing or constantly illuminated LEDs may be used to alert a user to various possible fault conditions. Audible alarms may also be used.

Also provided within the front housing 302 is an infrared sensor 312 coupled to an infrared control unit 314. The infrared sensor 312 can detect the presence of a cup, and through the operation of the infrared control unit 314 can transmit a signal indicative of the presence or absence of a cup. The dispenser 300 may thereby be prevented from dispensing liquid flavoring if no cup is present to receive it. Alternatively, the front housing 302 may be provided with a cup sensor array 313 (i.e. infrared array) that may detect the presence of a cup and also detect the particular size of cup (e.g. small, medium, large, or extra-large) placed on the cup support 308. As shown in FIG. 7 in dashed lines, such a sensor array 313 may include an emitter array 313*a* on one side of the front housing 302 and a receiver array 313*b* on the opposite side of the front housing 302. When activated, the receiver array 313*b* will only receive signals from elements of the emitter array 313*a* that are not blocked by the placement of a cup.

A controller 316 is situated in the rear housing 304, and is operably connected to the keypad 306, the display 307, the infrared control unit 314, and to a discrete volume pump 317 that is also positioned in the rear housing 304. One suitable pump is an MP 3 solenoid diaphragm pump (available from Compraelec, 29 rue Joseph Guerber, 67100 Strasbourg, France). Of course, other suitable pumps may also be used.

The controller 316 is adapted to receive signals from the infrared control unit 314, as described above, to indicate the presence or absence of a cup. Optionally, the infrared sensor 312 may also permit the controller 316 to prevent dispensing of additional liquid until the cup has been removed and replaced, to reduce the likelihood of accidental overflavoring. In the case where a cup sensor array 313 is provided, the controller 316 will be adapted to receive signals from the cup sensor array 313 and determine a cup size. The infrared sensor 312 and infrared control unit 314 may also be configured to permit the controller 316 to communicate with a Personal Digital Assistant (PDA), as will be described further below.

The controller 316 is also adapted to receive signals from the keypad 306, and transmit messages to the LEDs in the keypad 306, or to the display panel 307. A power source (not shown) is also connected to the controller 316. Details of the operation of the controller 316, and how it controls the operation of the dispenser 300, are set out below.

Figure 9:
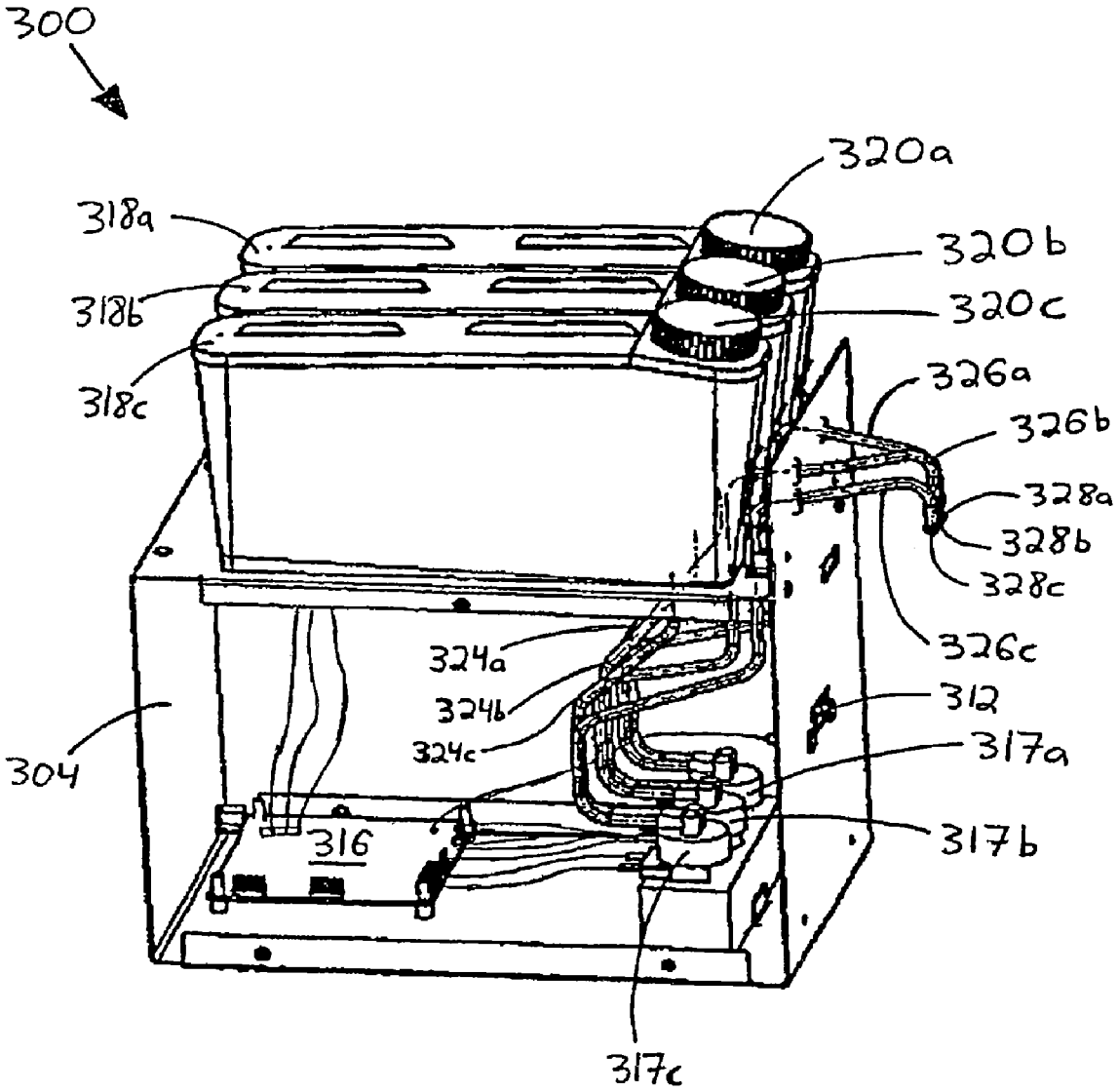
FIG. 9 is a side perspective view of the fluid dispensing system of FIG. 7 with portions of the outer housing removed.

With particular reference to FIG. 9, which is a side perspective view of the dispenser 300 with the front housing 302 and portions of the rear housing 304 removed, three reservoirs 318*a*, 318*b* and 318*c* for containing liquid flavoring are disposed in the rear housing 304, preferably in an upper portion thereof to facilitate refilling. Each reservoir could contain a different type of flavoring. For example, the reservoir 318*a* could contain an "Irish Cream" flavoring, the reservoir 318*b* could contain a "French Vanilla" flavoring, and the reservoir 318*c* could contain a "Hazelnut" flavoring.

As can be seen best in FIG. 9, each reservoir has a corresponding dedicated pump connected only to that reservoir. In particular, the discrete volume pump 317*a* is connected to the reservoir 318*a* by connector tube 324*a*, the discrete volume pump 317*b* is connected to the reservoir 318*b* by connector tube 324*b*, and the discrete volume pump 317*c* is connected to the reservoir 318*c* by connector tube 324*c*. Similarly, the outlet of each discrete volume pump 317*a*, 317*b* and 317*c* is in fluid communication with its own dedicated connector tube 326*a*, 326*b* and 326*c*, respectively. Each connector tube 326*a*, 326*b* and 326*c* is in turn in fluid communication with its own, separate dispensing outlet 328*a*, 328*b* and 328*c*, respectively. The use of separate pumps, tubing, reservoirs and dispensing outlets prevents cross-contamination between flavors. The dispensing outlets 328*a*, 328*b* and 328*c* may be placed in close, side-by-side proximity to each other, so that a receptacle such as a coffee cup can be placed in the same position regardless of which reservoir 318*a*, 318*b*, or 318*c* is being sourced.

Figure 10:
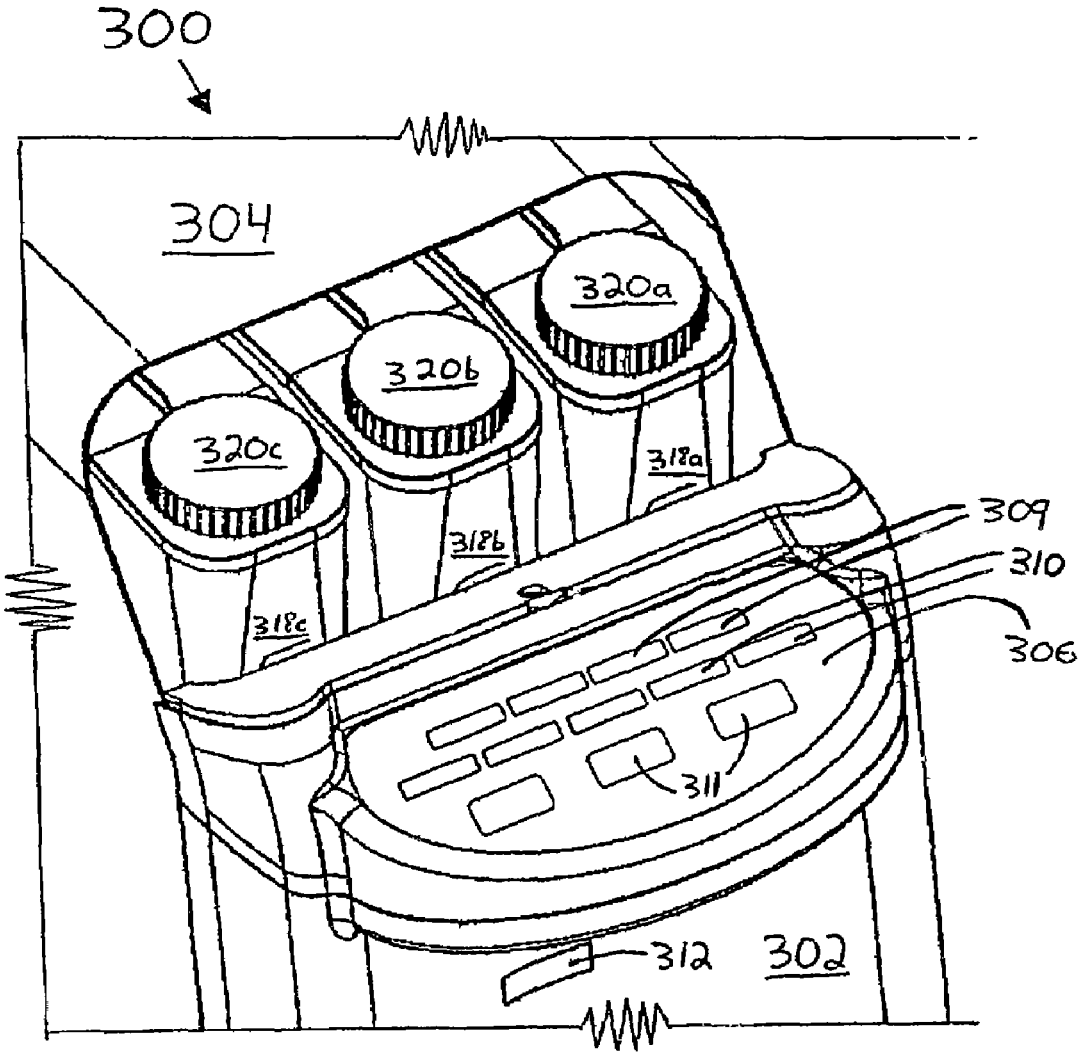
FIG. 10 is a front perspective view of a portion of the fluid dispensing system of FIG. 7 with the cover plate removed to expose internal reservoirs.

The reservoirs 318*a*, 318*b* and 318*c* are covered by a removable cover plate 319. A front perspective view of a portion of the dispenser 300 with the cover plate 319 removed is shown in FIG. 10. Each reservoir 318*a*, 318*b* and 318*c* has a removable sealing cap 320*a*, 320*b* and 320*c*, respectively, that can be removed when it is desired to add more liquid flavoring to a reservoir 318*a*, 318*b* and 318*c*, and then resealed to prevent evaporation or contamination of the liquid flavoring.

Now referring to FIG. 8, each reservoir may optionally be provided with a float switch 322*a*, 322*b* and 322*c* (only the float switch 322*b* is shown). A float switch 322*a*, 322*b* and 322*c* will be tripped when the level of flavoring in its respective reservoir 318*a*, 318*b* or 318*c* falls below a certain level, and will then transmit a signal to the controller 316. Any suitable float switch may be used. Optionally, the float switches 322*a*, 322*b* and 322*c* may be omitted, and a non-electronic visual indicator of the level of liquid in the reservoir may be used instead.

Alternatively, particularly in a situation where it is desirable to use disposable reservoirs which do not include a float switch, one or more microphones may be provided adjacent to the pumps 317 (in FIG. 8, one microphone 323 is shown located adjacent to pump 317*b*) so that controller 316 can aurally detect when a reservoir is empty or almost empty. It will be understood that a pump will generate a different sound or noise when pumping air (or an air/fluid mix) as opposed to fluid. As such, the controller 316 can be programmed such that when one of the pumps 317 (for example, pump 317*a*) is operated, the controller 316 will monitor the microphone 323 to detect a change in some characteristic of the sound produced by the pump 317*a* (such as frequency, amplitude or the like) or some combination of these characteristics as compared to normal pump operation or as compared to an empty or almost empty pump operation. The microphone 323 and controller 316 may further include various signal processing systems or technology to ensure that accurate detection of an empty reservoir occurs. For example, the controller 316 may use signal filtering, matched filters, autocorrelation methods or the like for this purpose. In a particular embodiment, the controller 316 may also control the microphone 323 to detect the ambient noise in advance of operation of the pump 317*a* to determine if a reasonably accurate detection of the sound of the pump 317*a* is possible. In the case that the sound of the pump 317*a* cannot be detected well, the controller 316 may either prevent dispensing of fluid or allow a limited number of dispenses based on an amount of fluid typically available in one of the connecting tubes 326 until a detection of the sound of the pump is again possible.

Further, it will generally be beneficial to analyze the detected sound over a plurality of cycles of pump operation or over a plurality of operations of the dispenser to provide confirmation of the result before setting or indicating an alarm condition. In a particular embodiment, if the pump is operating at 60 Hz, several samples can be taken during the first several cycles to determine if the characteristics of the sound are outside of a predetermined range or match with a predetermined profile of the sound of empty pump operation. As indicated above, if there is some volume of fluid typically available in the connecting tubes, it is possible to detect the sound over a plurality of fluid dispenser operations before setting or indicating an alarm condition.

Still referring to FIG. 8, temperature sensors 330*a*, 330*b* and 330*c* (only the temperature sensor 330*b* is shown) may be positioned to measure the temperature of the liquid flavoring contained in each of the reservoirs 318*a*, 318*b* and 318*c*. One such suitable sensor is a thermister. Such sensors would be configured so that they do not contaminate the contents of the reservoirs 318*a*, 318*b* and 318*c*. Alternatively, a single temperature sensor (not shown) may be used to sense the temperature in the atmosphere surrounding the reservoirs 318*a*, 318*b* and 318*c*, as an approximation of the temperature of the liquid flavorings contained therein. For example, a thermister may be coupled to the controller 316 for sensing the temperature within the dispenser 300. The temperature information could then be correlated by the controller 316 with information regarding the viscosity of the liquid flavoring at various temperatures, to permit the controller 316 to modify the number of pulses to be sent to the relevant discrete volume pump 317*a*, 317*b* or 317*c*, depending on the calculated viscosity of the liquid flavoring being dispensed. Alternatively, if feasible in the particular liquid flavoring dispenser 300, the viscosity may be measured directly.

Additionally, if different types of liquid flavoring are known to have different viscosity-temperature profiles, such data could be stored in controller memory and the controller 316 could be adapted to retrieve the relevant data indicative of the particular liquid flavoring contained in the particular reservoir 318*a*, 318*b* or 318*c*. This data may also be provided when different flavors require the use of different volumes of liquid flavoring to flavor the same drink. For example, the container in which the liquid flavorings are supplied may include a label having a numerical indicator which may be programmed into the controller 316 when the dispenser 300 is filled. For example, a manually adjustable potentiometer can be used as a means of providing this input to the controller 316. This input would direct the controller 316 to access a stored data set representative of the characteristic of the associated flavoring liquid.

It is also envisioned to provide reservoirs 318*a*, 318*b* and 318*c* that are removable from the dispenser 300. In such a case, each removable reservoir 318*a*, 318*b* or 318*c* could be provided with a valve (not shown) for connecting to a mating valve (not shown) provided to connector tubes 324. For a removable reservoir 318*a*, 318*b* or 318*c*, indicator means may be provided that, when the reservoir 318*a*, 318*b* or 318*c* is installed, causes the controller 316 to access a stored data set corresponding to the characteristics of the fluid contained in the installed reservoir 318*a*, 318*b* or 318*c*. Such an indicator could comprise a mechanical tab for actuating a switch that transmits a signal to the controller 316, or a passive transponder, or any other suitable indicator. In the case that the reservoirs are removable, they may also be disposable or be subject to recycling.

As noted above, the keypad 306 has drink selection keys 309, size selection keys 310, and flavor selection buttons 311.

Examples of different types of drinks that might be flavored include coffee, cappuccino, latte and soda, among others. The additional input of the type of drink to be flavored will permit the controller 316 to make further appropriate modifications to the number of pulses to ensure that the volume of liquid flavoring being dispensed is appropriate for the type of drink being flavored. For example, a different volume of liquid flavoring may be required to flavor a given size of cappuccino than to flavor a latte of the same size.

Preferably, the selection by a user of a particular flavor will be achieved by selection of the reservoir 318*a*, 318*b*, or 318*c* in which the desired liquid flavoring is contained. This selection process may be facilitated by using the display 307 to indicate the type of flavor contained within each reservoir 318*a*, 318*b* and 318*c*, or decals or other direct physical indicators may be placed in positions corresponding to the reservoir whose contents they describe. Pushing a flavor selection key 311 on the keypad 306 will preferably transmit a signal to the controller 316, the signal containing information sufficient for the controller to determine the appropriate reservoir and pump combination.

For example, if a user wished to add "French Vanilla" flavoring to a large cappuccino, the user would press the drink selection key 309 corresponding to "cappuccino", the size selection key 310 corresponding to "large", and the flavor selection button 311 corresponding to the reservoir 418*b* (and hence to "French Vanilla"). As noted above, the correlation between the button corresponding to the reservoir 418*b* and the "French Vanilla" liquid flavoring contained therein could be achieved in any number of ways.

When pressed, the keys 309, 310 and 311 would each transmit a signal to the controller 316. The information contained in these signals would permit the controller 316 to determine the selected reservoir and pump combination, as well as the appropriate number of pulses. As noted above, the controller 316 may also process other information, such as temperature or a direct measurement of viscosity, as well as other indicators representative of various other properties of the particular type of liquid flavoring contained in the reservoir 318.

In the example above, the controller 316 would receive a signal from each of the depressed keys 309, 310 and 311, as well as any signals transmitted by the various sensors. The controller 316 would then transmit the appropriate number of pulses for flavoring a large cappuccino with "French Vanilla", modified as dictated by any received sensor signals, to the discrete volume pump 317*b*. This will drive the discrete volume pump 317*b* to operate over the appropriate number of cycles or sub-cycles and thereby pump an appropriate volume of liquid flavoring. As a result of the operation of the pump 317*b*, a desired quantity of liquid flavoring will be pushed by the pump 317*b* through the connector tube 326*b* and out of the dispensing outlet 328*b*. An essentially equal amount of liquid flavoring will be withdrawn from the reservoir 318*b* through the connector tube 324*b*. In the case of a simple reciprocating pump, this would occur during the course of each cycle, and in the case of an incrementally operable reciprocating pump, this would occur after the sub-cycles had been completed.

One skilled in the art will appreciate that a "flush" mode should be provided, in which a selected discrete volume pump 317*a*, 317*b* or 317*c* can be made to repeat its cycles at a high rate of speed for a specific period of time. This "flush" cycle can be used to prime the selected pump 317*a*, 317*b* or 317*c* to remove air so that the liquid flavoring will be properly dispensed, or with water in the associated reservoir 318*a*, 318*b* or 318*c* to clean the pump before changing flavors. Preferably, pressing a certain combination of keys 309, 310, 311 will initiate the "flush" cycle.

One skilled in the art will further appreciate that the dispenser 300 may be configured so that the keypad 306 can be used to program or modify various settings of the controller 316.

Second Example of a Liquid Flavoring Dispenser

Figure 11:
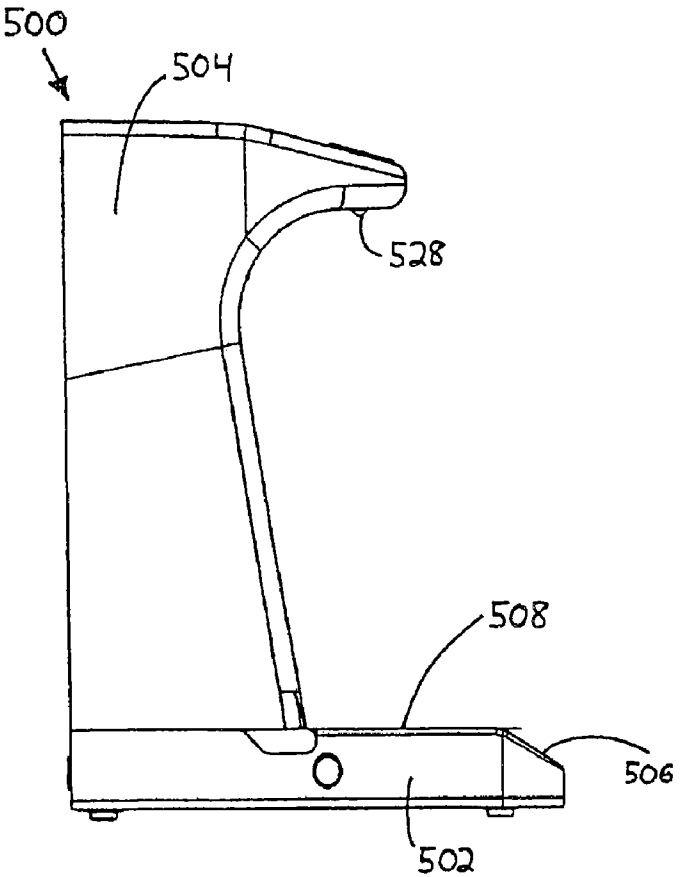
FIG. 11 is a side view of a fluid dispensing system according to another embodiment of the invention.

With reference now to FIGS. 11, 12, 13, 14 and 15, a second example of a liquid flavoring dispenser 500 is shown. The liquid flavoring dispenser 500 is suitable not only for restaurant use, but also for use in a home or office environment. The liquid flavoring dispenser 500 comprises a bottom housing 502 and a top housing 504. The top housing 504 is removable from the bottom housing 502. FIG. 11 shows the liquid flavoring dispenser 500 with the top housing 504 removed. Preferably, the top housing 504 is pivotally mounted to the bottom housing 502 so that portions of the bottom housing 502 that are covered by the top housing 504 can be exposed by pivoting the top housing 504 forward relative to the bottom housing 502.

Figure 12:
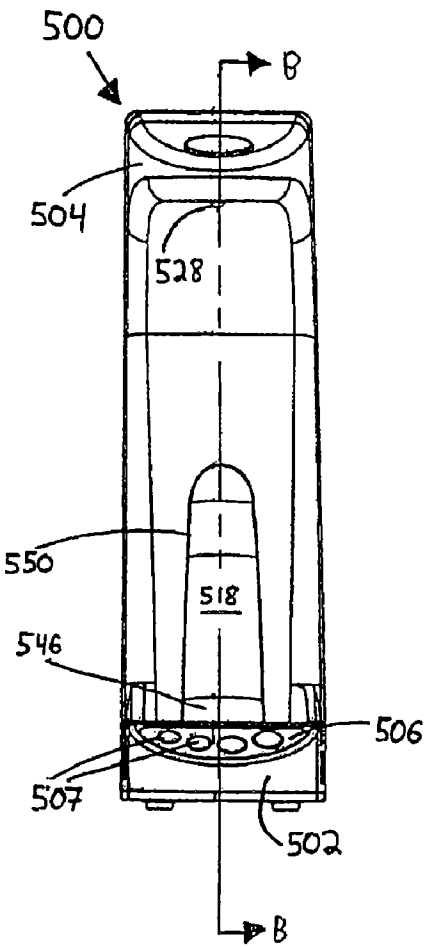
FIG. 12 is a front view of the fluid dispensing system of FIG. 11.

The liquid flavoring dispenser 500 has a keypad 506 having a plurality of keys 507, and a cup support 508, both positioned on the bottom housing 502. As can be seen in FIG. 12, a controller 516 and a discrete volume pump 517 is disposed in the bottom housing 502. The controller 516 is operably coupled to the keypad 506 and to the discrete volume pump 517, as well as to a power source (not shown).

Figure 13:
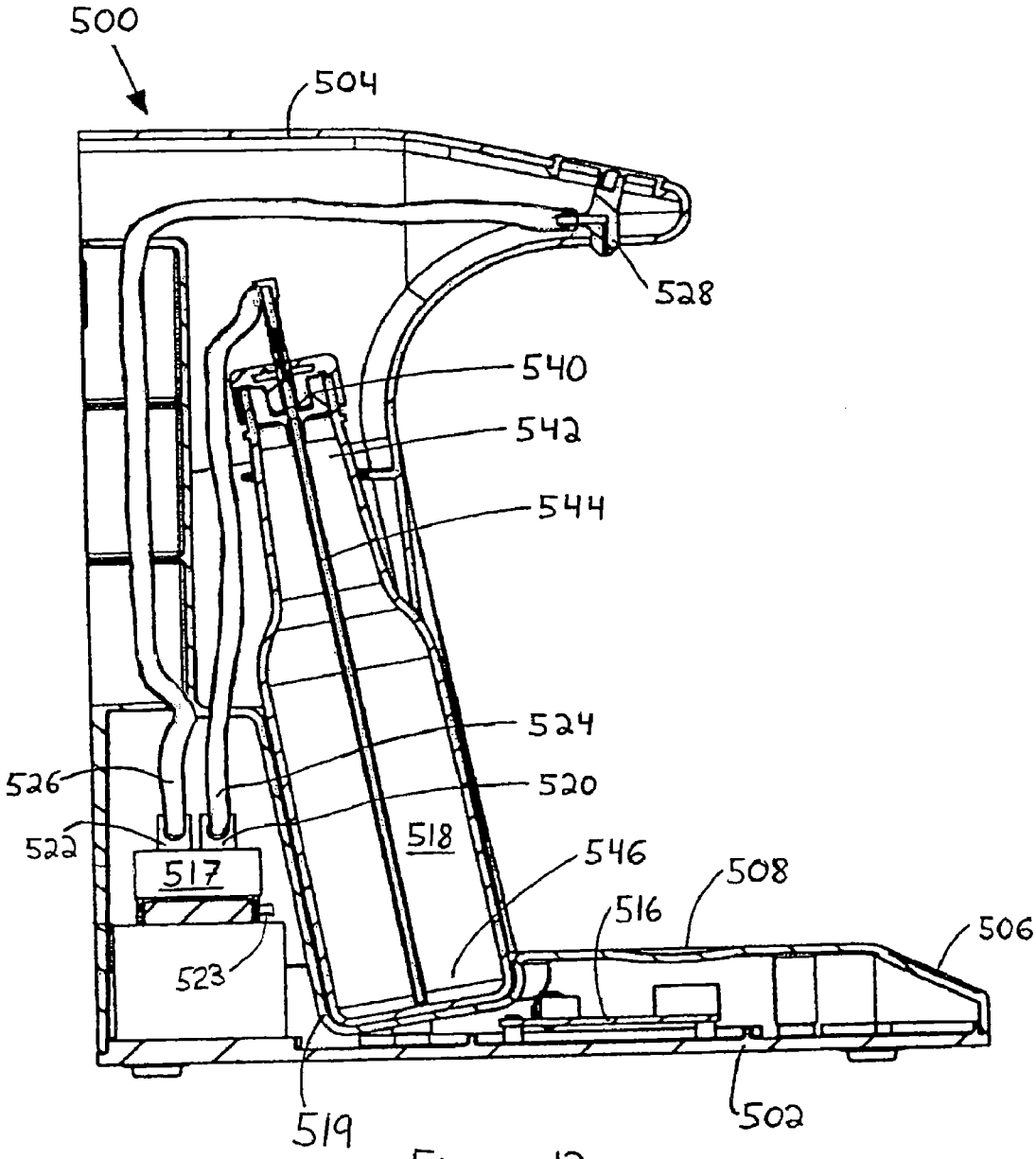
FIG. 13 is a cross sectional view of the fluid dispensing system of FIG. 11, taken along the line B-B in FIG. 12.
Figure 14:
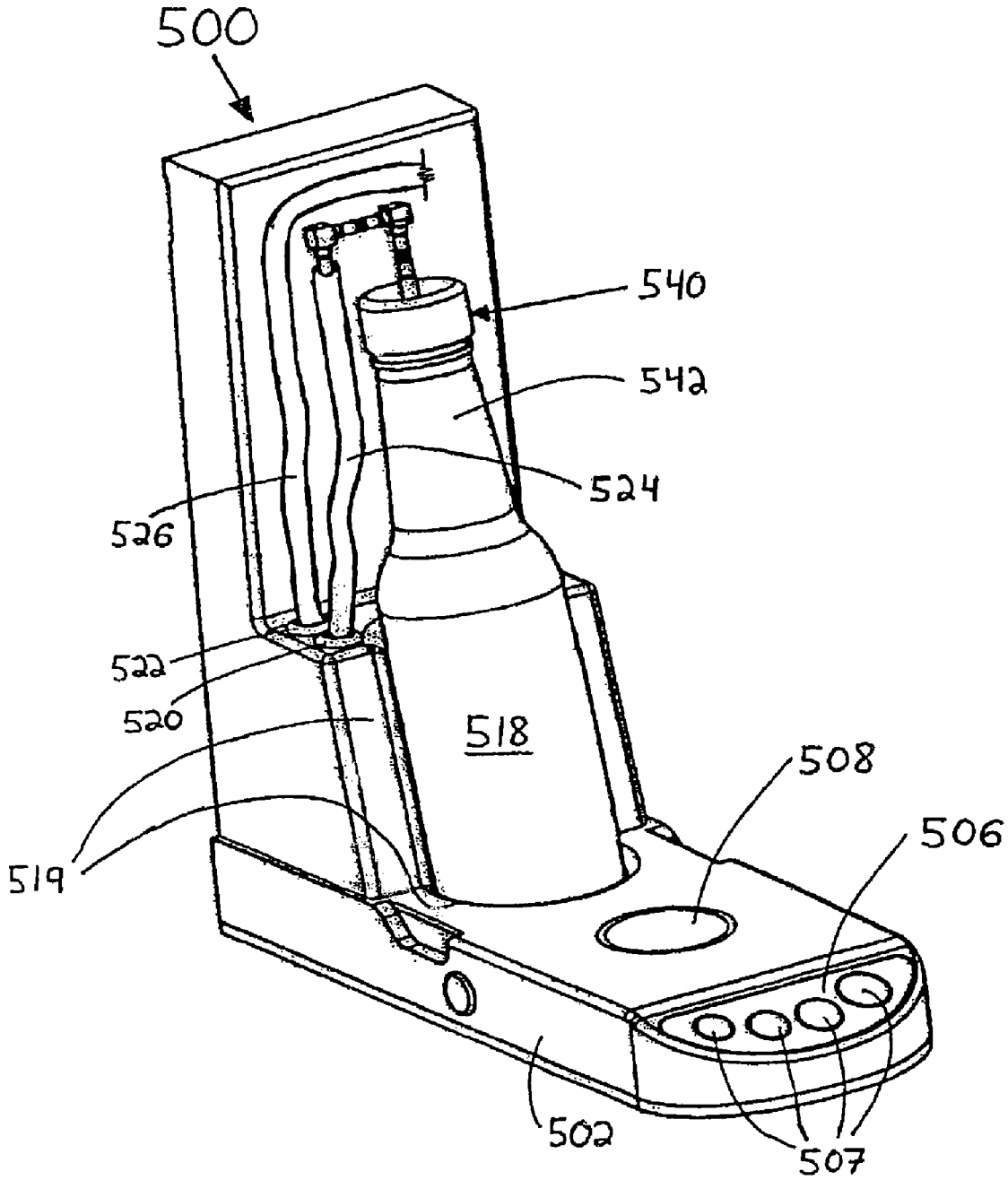
FIG. 14 is a front perspective view of the fluid dispensing system of FIG. 11 with the upper housing removed.
Figure 15:
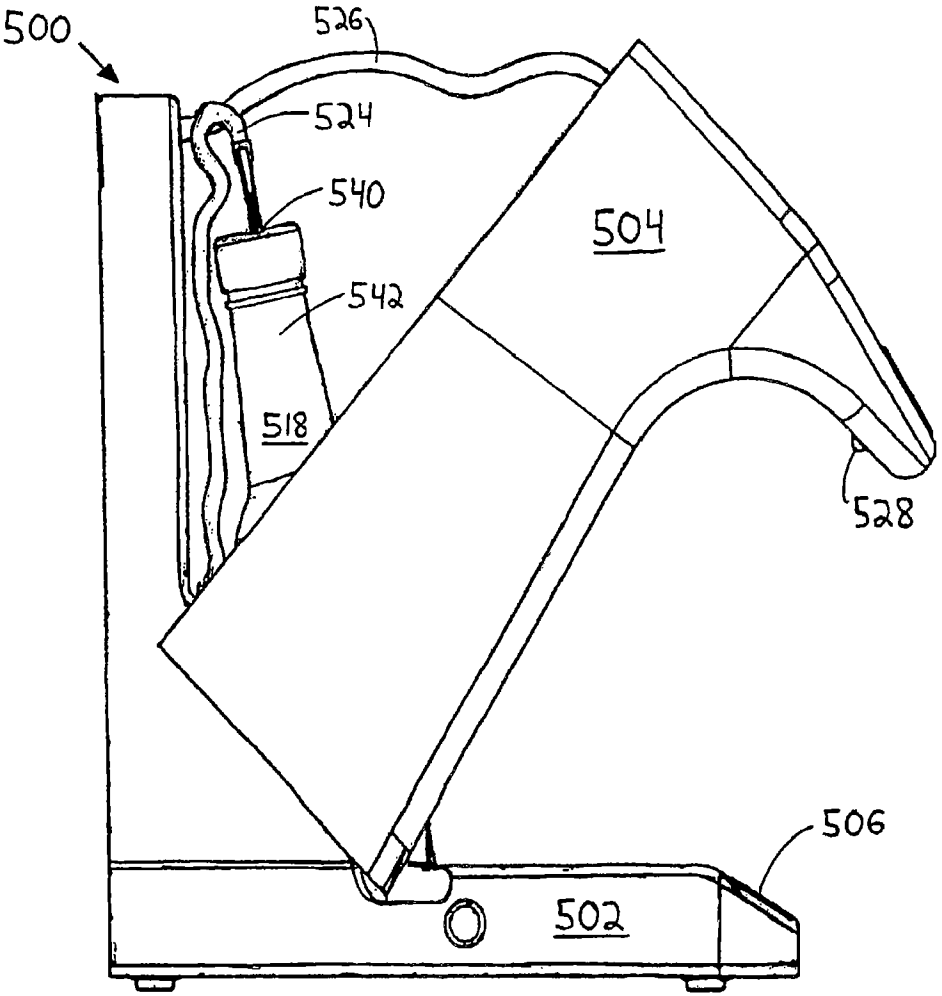
FIG. 15 is a side view of the fluid dispensing system of FIG. 11 with the upper housing pivoted forward.

As can be seen in FIGS. 13 and 14, a removable reservoir 518 in the form of a bottle 518 of substantially conventional shape may be placed in the liquid flavoring dispenser 500. The bottle 518 may be disposable or may be recycled in some manner. As best seen in FIG. 14, the bottle 518 rests in a cradle 519 defined in the bottom housing 502 and ordinarily substantially covered by the top housing 504.

The discrete volume pump 517 has a liquid inlet 520, and a liquid outlet 522. A first connector tube 524 is connected between the liquid inlet 520 and the bottle 518, and a second connector tube 526 is connected between the liquid outlet 522 and dispensing outlet 528. The dispensing outlet 528 is of course positioned over top of the cup support 508.

As best seen in FIG. 13, the bottle 518 has a special cap or insert 540 placed in its upper neck 542. The insert 540 has a full-length feed tube 544 extending to the bottom 546 of the bottle 518, and also has a small breathing aperture (not shown) defined therein. One end of the first connector tube 524 is coupled to the insert 540, and the other end of the first connector tube 524 is coupled to the liquid inlet 520 of the discrete volume pump 517, as described above. Thus, the discrete volume pump 517 is connected in fluid communication with interior of the bottle 518 through the first connector tube 524.

In operation, assuming the discrete volume pump 517 has already been primed, a user would first place a cup (not shown) on the cup support 508 so that it is disposed beneath the dispensing outlet 528. The user would then press a button 507 on the keypad 506, the button 507 corresponding to the size of the cup. Pressing the button 507 will transmit a signal to the controller 516, resulting in the controller 516 transmitting a discrete number of pulses to the discrete volume pump 517. The number of pulses transmitted by the controller 516 will drive the discrete volume pump 517 to operate over a number of cycles or sub-cycles calculated to dispense the volume of liquid flavoring needed to flavor a beverage of the size selected by pressing the button 507. A corresponding volume of liquid flavoring will be drawn out of the bottle 518 through the feed tube 544, with the volume of liquid withdrawn from the bottle 518 being replaced with air drawn in through the breathing aperture in the insert 540.

Referring to FIG. 12, it can be seen that the portion of the top housing 504 which covers the bottle 518 has a window 550 defined therein. The window 550 may comprise an aperture, or may comprise a piece of transparent material. If the label on the bottle 518 is appropriately sized so that the bottom portion 546 of the bottle 518 is uncovered, and the bottle 518 is made from a transparent material, the window 550 will permit a user to see when the bottle 518 is almost empty. Preferably, the liquid flavoring contained in the bottle 518 will be of a color that facilitates observation of the level of liquid contained in the bottle 518, without discoloring the beverage to which the flavor is added. The window 550 also permits a user to observe a label on the bottle 518 so as to determine the type of flavoring that will be dispensed from the dispenser 500. Alternatively, as described above, a microphone 523 may be placed adjacent to the pump 517 so that the controller 516 can detect a change in the sound of the pump 517 in order to determine when the bottle 518 is empty or nearly empty and provide an alarm.

Once the supply of liquid flavoring contained in the bottle 518 has been depleted, the bottle 518 may be replaced as follows, with reference to FIG. 13, the top housing 504 is tilted forward relative to the bottom housing 502, as shown, to expose the bottle 518, and in particular the neck 542 and insert 540. The first connector tube 524 is then disengaged from the insert 540, and the bottle 518 may then be grasped by its neck 542, lifted out of the cradle 519 (not shown in FIG. 13) and removed from the liquid flavoring dispenser 500. A new bottle 518 of liquid flavoring may then be placed in the cradle 519 (not shown in FIG. 13), and the first connector tube 524 may be connected to the insert 540 in the new bottle. The upper housing may then be pivoted back to a closed position, as shown in FIG. 11, and the discrete volume pump 517 may then be primed so that the liquid flavor dispenser 500 is ready for use. If the bottle 518 is replaced before the liquid flavoring supply is completely exhausted, it should not be necessary to prime the discrete volume pump 517. If the bottle 518 is replaced with a new bottle 518, it is preferable that the discrete volume pump 519 be flushed with water before the new bottle 518 is installed.

If desired, the controller 516 may be provided with input means to indicate the particular flavor being dispensed, so that the controller can adjust the number of pulses, and hence the volume of liquid flavoring dispensed, on the basis of the known viscosity or other characteristics of a given liquid flavoring.

One skilled in the art will of course appreciate that many of the features and functions described above in respect of the liquid flavoring dispenser 300 may be incorporated, with appropriate modifications, into the liquid flavoring dispenser 500.

In addition, the liquid flavoring dispenser 500 may be adapted so that multiple dispensers 500 may be connected in electrical parallel and powered by a single power source (not shown).

It will also be appreciated that while a dispenser 300, 500 constructed in accordance with an aspect of the present invention will have a high degree of accuracy, it is inherent that some loss of liquid will occur within the tubing and connections. Nonetheless, with accurate calibration, it is possible to obtain sufficient accuracy to achieve the purposes of the present invention.

One skilled in the art will further appreciate that it may be possible to adapt certain types of pumps that are not, in the strict sense, discrete volume pumps, in such a way as to render them useful in a liquid dispenser according to an aspect of the present invention. For example, it may be possible to adapt a peristaltic pump using a stepping motor so that its motion can be controlled to produce discrete pulses.

Description of a Controller

Referring back to FIG. 6, and as described above, in some implementations of fluid dispensing system 200, a controller 205 is used to co-ordinate the operation of the elements of the fluid dispensing system 200. As noted earlier, the operation of the fluid dispensing system 200 includes precise control of the mechanical elements, dosage calibration, sensing functions relating to the fluid to be dispensed, user control and maintenance.

One skilled in the art will appreciate that a controller 205 suited for use in a fluid dispensing system 200 in accordance with aspects of an embodiment of the invention includes a suitable combination of hardware, software and firmware that is operably coupled to at least one of a number of sensors, pumps and other mechanical systems that make-up the fluid dispensing system 200. According to an example implementation, a controller 205 suited for use within a fluid dispensing system 200 in accordance with an embodiment of the invention includes a controller 205 provided with a reprogrammable computer readable code means, memory (preferably, RAM and EEPROM), input/output ports and a clock/timing circuit.

Also as noted above, in some implementations, the fluid dispensing system 200 includes a number of sensors. Each of the sensors may be connected to the controller 205 so that signals from the sensors can be processed and acted upon as required.

For example, the fluid dispensing system 200 can optionally include a cup-sensing sensor positioned to detect the presence or absence of a receptacle under a fluid dispensing outlet. If the cup-sensing sensor does not detect a receptacle under the fluid dispensing outlet the corresponding systems typically enlisted in dispensing a fluid are prevented from operating to dispense any fluid. Alternatively, if a receptacle is detected, the corresponding systems are controlled to permit dispensing of the fluid. In some implementations, the cup-sensing sensor comprises an infrared sensor (e.g. the infrared sensor 312) positioned to detect the presence or absence of a receptacle under a fluid dispensing outlet (as described above). In related embodiments, dispensing of a fluid may occur automatically in response to the detection of a receptacle by the cup-sensing sensor. Further, also as described above, the cup-sensing sensor (e.g. cup sensor array 313) may detect the size of cup so that the controller 205 may control the dispensing accordingly. For example, the controller 205 may provide an alarm to request confirmation if a large dose of flavoring is selected for a medium cup or by automatically selecting a dosage size based on cup size. In a particular case, it may be possible to include a user override following an alarm if additional flavoring has been requested.

Fluid dispensing system 200 can also optionally include a means of establishing a wireless datalink. For example, a wireless datalink can be used to establish a connection with a handheld device (e.g. a Personal Digital Assistant or a notebook computer), so that fluid dispensing system 200 can be monitored for diagnostic reasons and/or re-programmed to update control features provided by the fluid dispensing system 200. One example implementation of the means for establishing the wireless datalink would be an infrared sensor. Alternatively, the wireless datalink could be advantageously combined with the cup-sensor described above that will also make use of the infrared sensor. For example, a BLUETOOTH™-based chip or communication system could be used to establish the wireless datalink. One skilled in the art will appreciate that any number of wired or wireless link protocols and systems may be used to establish a datalink in accordance with the invention.

The fluid dispensing system 200 includes sensors to measure the characteristics of a fluid to be dispensed. For example, a volume sensor can be used to generate a signal that reflects an indication of the volume of a fluid in the dispensing system 200 (e.g. the float switches 322*a*, 322*b* and 322*c*). The controller 205 can use this signal generated by the sensor to alert a user when the volume of the fluid in a reservoir should be refilled (e.g. by way of auditory or visual warning). Alternatively, it may be preferable to provide one or more small microphones (not shown) adjacent to the pumps to allow the controller 205 to detect a change in the sound of the pumps to indicate when the reservoir should be filled. This arrangement may be effective in order to reduce the overall cost of the fluid dispensing system 200 and particularly effective when the reservoirs are disposable.

Similarly, sensors can be used to measure characteristics such as, but not limited to, temperature, viscosity, acidity, carrier concentration, ion concentration, density, resistance and color. Such sensors can be used to enhance the functionality and operation of the fluid dispensing system 200. As described above, it will be understood by one skilled in the art that there will be occasions when a sensor used to detect one characteristic of the liquid flavoring may also indicate an additional characteristic. For example, due to the known variation of viscosity in relation to temperature, it may be possible to utilize a measure of temperature to determine the approximate viscosity of the liquid flavoring.

Sensor measurements can then be used to change the dosage calibration before or during the use of the fluid dispensing system 200. This specific aspect of the invention will be discussed in detail below with further reference to the pulse generator 202 and the controller 205 described above.

The fluid dispensing system 200 preferably includes a keypad (or keyboard) that provides a user with a means to interact with the fluid dispensing system 200 (e.g. keypads 306, 506). The keypad can be used to program, calibrate, maintain and/or use the fluid dispensing system 200 to dispense a fluid.

As discussed above, a pulse generator 202 is used to drive the operation of a discrete volume pump. The controller 205 is programmed to provide the correct number of pulses (i.e. the predetermined number of pulses) in response to a selection of a quantity and type of fluid desired by a user. The number of pulses required for a standardized dosage for a particular fluid (e.g. a flavoring fluid) is adjusted by the controller 205 in response to various sensor measurements and/or information provided by a user. For example, a user may provide additional data to indicate the type of beverage being flavored, which may require an adjustment in the volume of fluid dispensed.

In one example implementation, pulses per dose are derived from an AC power source. A circuit is provided that derives a train of pulses corresponding to the zero crossings of the AC power signal. The circuit is further configured to provide a portion of the train of pulses to the mechanical means used to drive the pumps and other mechanical systems as described above. However, to reiterate, a particular dosage of a flavoring-fluid is dispensed by cycling a discrete volume pump a respective number of times to obtain the desired volume of flavoring, or in the case of an incrementally operable discrete volume pump, by driving the pump over a number of sub-cycles. The continuously generated pulse train cannot simply be coupled to the mechanical systems used to drive the pumps. Accordingly, a switching means in the circuit is provided to limit the number of pulses sent to the mechanical systems used to drive the pumps so that the correct volume/dosage of the flavoring fluid is dispensed.

Alternatively, the pulses per dose may be derived from a timing circuit. Controller 205 uses a micro-controller that has an internal clock for its own timing requirements. The continuous train of pulses is taken directly from the timing circuit, instead of being derived from an AC power source as described above. Deriving the pulses per dose from a clock circuit included in controller 205 permits the use of a DC power source, such as an electrochemical battery or solar cell, since the zero crossing from the AC power source are not required to generate any pulses.

As discussed above, dosage calibration is carried out in response to measurements of the fluid. A means for calibrating a fluid dispensing system 200 in accordance with aspects of an embodiment of the invention is provided in some embodiments.

As noted above, small amounts of flavoring can have a significant effect on the perceived taste of a beverage, so it is beneficial to control the actual amount of pure flavoring compounds added to a beverage. Calibration is a desirable feature in some embodiments because the concentration of pure flavoring compounds in a volume of favoring fluid can change over time and/or in relation to environmental conditions. For example, the flavoring fluid becomes noticeably more concentrated if a significant amount of the carrier evaporates relative to the pure flavoring compounds. As another example, the amount of pure flavoring compounds provided per pulse can change as a function of temperature. Temperature affects the viscosity of the fluid and if the temperature increases, more fluid per pulse may flow as a result and vice versa. Consequently, depending on the temperature, the amount of pure flavoring compounds provided can change independently of the selection of the dosage by a user.

Accordingly, the controller 205 can be programmed to accept calibration input from a user and/or self-calibrate in relation to stored data about a particular flavoring fluid and/or sensor readings. For example, the controller 205 may be programmed to adjust the number of pulses per dose of a particular flavoring fluid, based on the viscosity of the particular flavoring fluid relative to the viscosity of water. Alternatively, the controller 205 could be programmed to adjust the number of pulses per dose of a particular flavoring fluid, based on the viscosity of the particular flavoring fluid relative to the viscosity of another standardized flavoring fluid and/or the relative change in viscosity between the two flavoring fluids over time.

The number of pulses per dose can be further adjusted to compensate for changes due to temperature, evaporation, or other measurable values that are linked with a perceived change in the flavor/taste of the fluid as a function of volume per pulse. One skilled in the art will appreciate that an adjustment of the number of pulses provided per dose can be standardized to a specific type of quantity related to a measurable physical characteristic, such as, but not limited to, temperature, carrier concentration, pure flavoring concentration, viscosity, density, color, etc. Furthermore, calibration steps with any combination of measurements can be carried out in any suitable order without departing from the scope of the invention.

Figure 16:
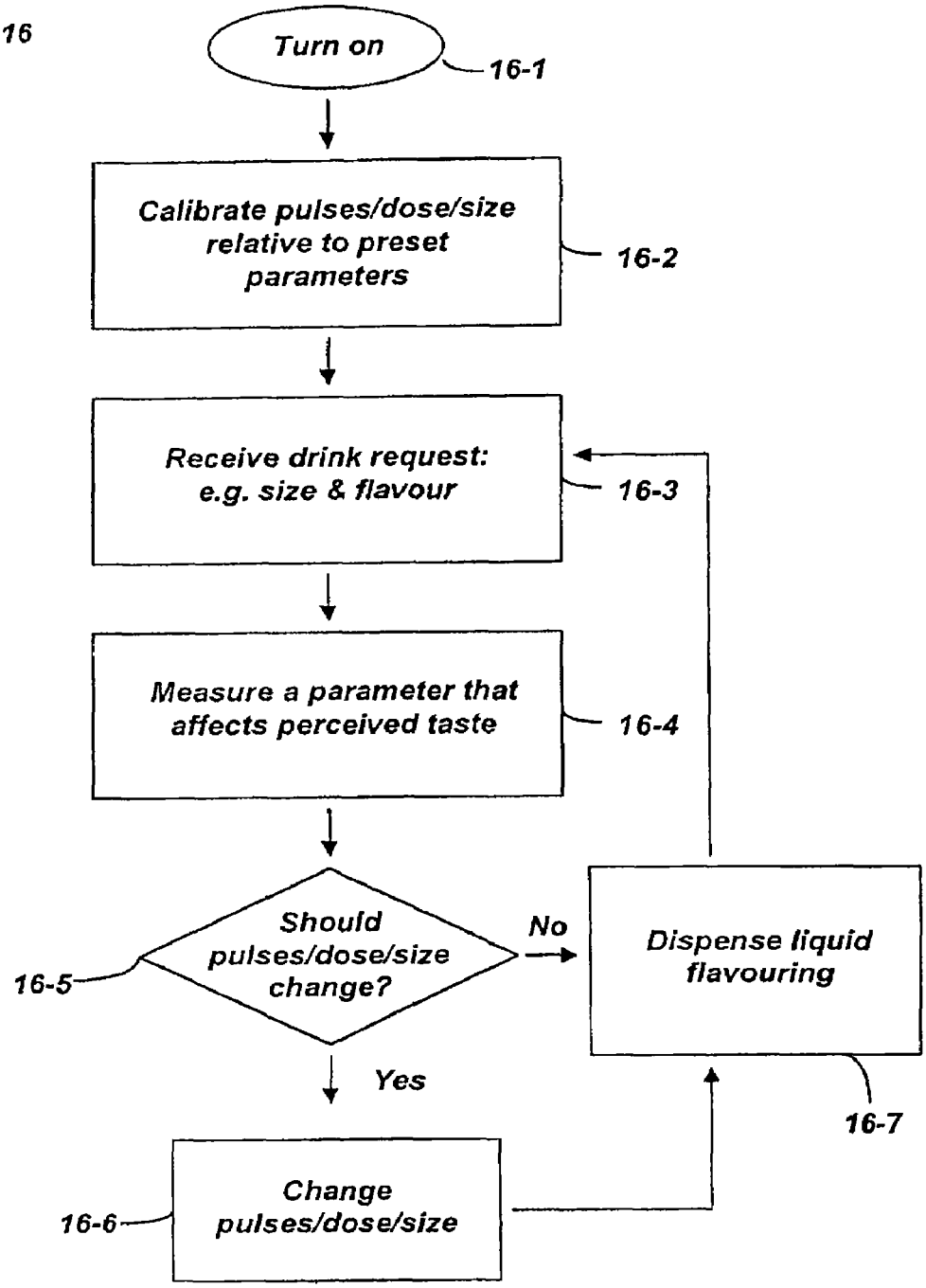
FIG. 16 is a flow chart showing an example of the operation of a controller.

FIG. 16 is a flow chart that illustrates one specific example set of processing steps executed by controller 205 for a fluid dispensing system 200 in accordance with the invention. Starting at 16-1, the fluid dispensing system 200 (FIG. 6) is turned on. That is, a power source (not shown) is coupled to the fluid dispensing system 200.

At 16-2, the controller 205 calibrates the number of pulses per dose (per size of beverage) for each particular flavor provided by the fluid dispensing system 200. Calibration settings are stored in memory coupled to or integrated within the controller 205. Alternatively, calibration settings are entered by a user and/or derived from inputs provided by the user. After 16-2, the fluid dispensing system 200 waits for a user to input a request for a beverage of a particular size.

At 16-3, the controller 205 receives a request for a beverage of a particular size from the user. Such a request includes the size and flavor of the beverage requested. The size and flavor of the beverage requested is used to derive the precise dosage of the flavoring to be dispensed for the beverage, in terms of pulses per dose.

At 16-4, the controller 205 measures a parameter that affects the perceived taste of the flavoring liquid. As noted above, such parameters include, but are not limited to, temperature, carrier concentration, pure flavoring concentration, viscosity, density, color, etc.

At 16-5 the controller 205 determines whether or not the pulses per dose (per size of the beverage) should be adjusted based on the measurement of the parameter in 16-4. If it is determined that the pulses per dose do not need to change (no path, 16-5), the controller 205 proceed to 16-7. On the other hand, if it is determined that the pulses per dose should be changed (yes path, step 16-5), the controller 205 proceeds to 16-6 in which the pulses per dose are changed for the particular drink request received at 16-3. The controller 205 then proceeds to 16-7.

At 16-7, the controller 205 signals the fluid dispensing system 200 to dispense an appropriate liquid flavoring according to the pulses per dose (per size) based on the appropriate pulses per dose calculated.

Figure 17:
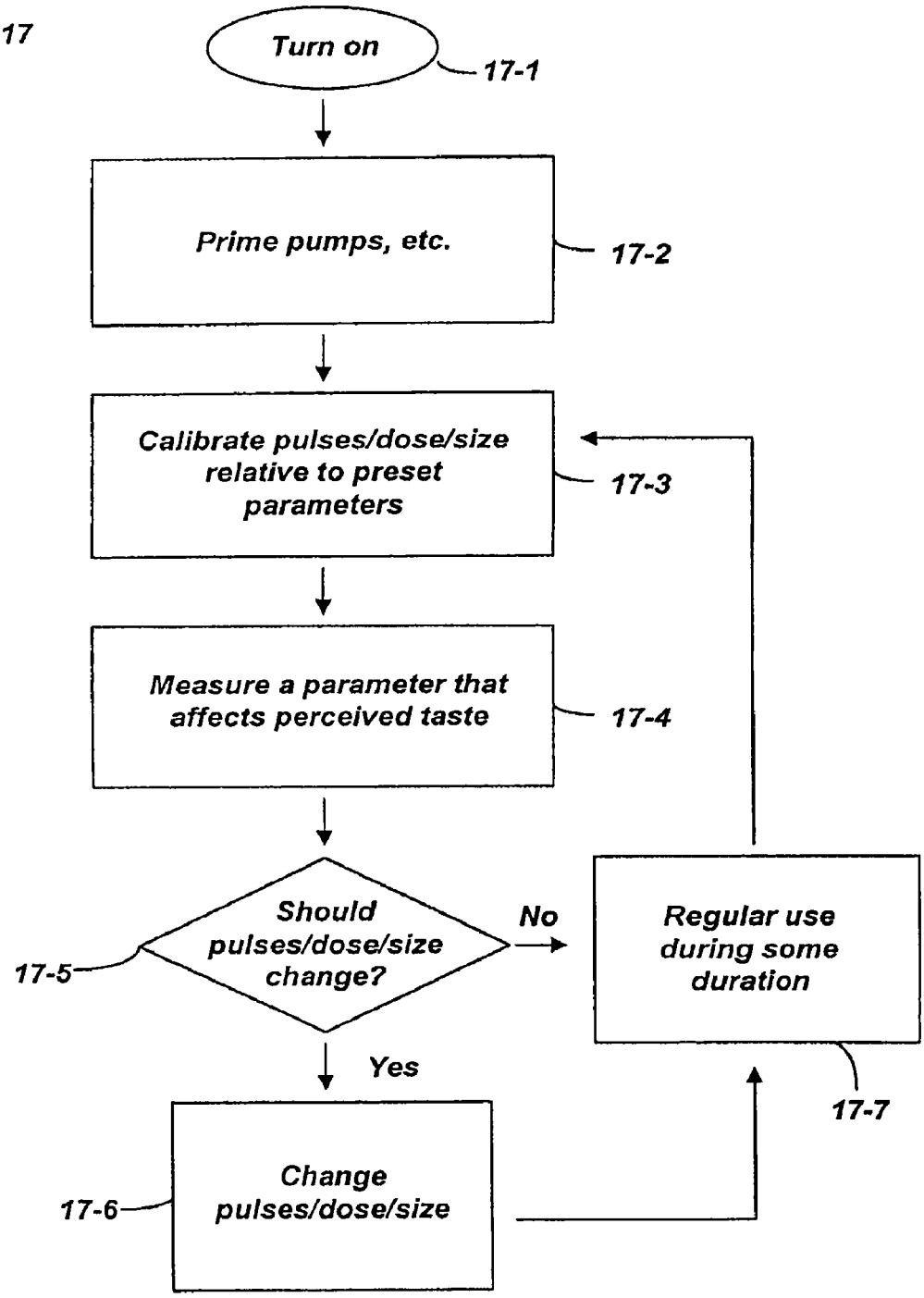
FIG. 17 is a flow chart showing another example of the operation of a controller.

FIG. 17 is a flow chart illustrating another specific example set of process steps executed by the controller 205 within fluid dispensing system 200 in accordance with the invention. Starting at 17-1 a fluid dispensing system 200 (FIG. 6) is turned on. That is a power source (not shown) is coupled to the fluid dispensing system 200.

At 17-2, the controller 205 "primes" one or more pumps (e.g. discrete volume pump 204 shown in FIG. 6) included in the fluid dispensing system 200. The controller 205 also operates to "prime" other mechanical systems that are included in the fluid dispensing system 200.

At 17-3, the controller 205 calibrates the number of pulses per dose (per size of beverage) for each particular flavor provided by the fluid dispensing system 200. In some embodiments calibration settings are stored in memory coupled to or integrated within the controller 205. In other embodiments the calibration settings are entered by a user and/or derived from inputs provided by the user.

At 17-4, the controller 205 continues with a calibration procedure and measures a parameter that affects the perceived taste of the flavoring liquid. As noted above, such parameters include, but are not limited to, temperature, carrier concentration, pure flavoring concentration, viscosity, density, color, etc.

At 17-5 the controller 205 determines whether or not the pulses per dose (per size of the beverage) should be adjusted based on the measurement of the parameter in 17-4. If it is determined that the pulses per dose do not need to change (no path, 17-5), the controller 205 proceeds to 17-7. On the other hand, if it is determined that the pulses per dose should be changed (yes path, 17-5), the controller 205 proceeds to 17-6 in which the pulses per dose are changed. The controller 205 then proceeds to 17-7.

At 17-7, the controller 205 instructs the different portions of the fluid dispensing system 200 to operate to dispense corresponding doses of any number of liquid flavorings based on requests by one or more users. That is, the fluid dispensing system 200 dispenses the appropriate liquid flavoring according to the pulses per dose (per size) based on the appropriate pulses per dose calculated during the previous steps each time a beverage request is received during 17-7. In order to update the pulses per dose (since they may change over time), after the duration of time, the controller 205 loops back to 17-4 where the parameter that affects the perceived taste of the flavoring liquid is again measured and controller 205 repeats 17-5 to 17-7 as required.

What has been described is merely illustrative of the application of the principles of the invention. Other arrangements and methods can be implemented by those skilled in the art without departing from the scope of the present invention.

We claim:

1. A liquid dispensing apparatus for beverages, the apparatus comprising:

a) a liquid reservoir for storing a liquid flavoring;

b) a diaphragm pump, the diaphragm pump having:

i. a housing with inner walls that define a pump chamber;

ii. the housing having a fluid inlet in communication with the liquid reservoir and the pump chamber, and a fluid outlet in communication with the pump chamber and a dispensing outlet for dispensing the liquid flavoring; and iii. a flexible diaphragm movable within the pump chamber between a first position and a second position, wherein a predetermined volume of liquid flavoring is drawn into the pump chamber via the fluid inlet when the diaphragm moves from the first position to the second position, and the predetermined volume of liquid flavoring is expelled from the pump chamber via the fluid outlet when the diaphragm moves from the second position to the first position;

c) a pulse generator configured for generating discrete pulses, each discrete pulse causing the diaphragm pump to move through one discrete cycle; and d) a controller operatively coupled to the pulse generator for controlling the diaphragm pump, the controller being configured to:

i. receive a user request for a particular beverage;

ii. determine a number of discrete pulses to be generated based on at least one of: a signal relating to a volume of the liquid flavoring to be dispensed, at least one variable associated with the liquid flavoring, a preset parameter associated with the liquid flavoring, and an input associated with the user request; and iii. activate the pulse generator to generate the number of discrete pulses, each pulse of the pulse generator causing the flexible diaphragm pump to move through one discrete cycle and the predetermined volume of liquid flavoring to be drawn into the pump chamber and expelled from the pump chamber via the dispensing outlet.

2. The apparatus of claim 1, further comprising a cup sensor configured to detect the presence of a cup proximate the dispensing outlet and to generate the signal relating to the volume of liquid flavoring to be dispensed based on a size of the cup.

3. The apparatus of claim 2, further comprising at least one liquid sensor operably connected to the controller for sensing the at least one variable associated with the liquid flavoring and communicating a signal associated with the at least one variable to the controller to vary the number of discrete pulses to be generated.

4. The apparatus of claim 1, further comprising a sensor connected to the controller for sensing the at least one variable associated with the liquid flavoring and for communicating the signal relating to the volume of liquid flavoring to be dispensed to the controller based on the at least one variable.

5. The apparatus of claim 1, further comprising at least one sensor operably connected to the controller for sensing the at least one variable associated with the liquid flavoring and for communicating a signal associated with the at least one variable to the controller to vary the number of discrete pulses to be generated.

6. The apparatus of claim 1, wherein the pump chamber has a volume less than approximately 0.05 ml.

7. The apparatus of claim 1, further comprising at least one sensor operably coupled to the controller for sensing a receptacle for receiving the liquid flavoring and wherein the controller is operable to only dispense liquid flavoring when a receptacle is sensed.

8. The apparatus of claim 7, wherein the at least one sensor further senses a size of the receptacle and the predetermined amount of liquid flavoring is determined by the controller based on the size of said receptacle.

9. A liquid dispensing apparatus for beverages, the apparatus comprising:

a) a liquid reservoir for storing a liquid flavoring;

b) a diaphragm pump operable over discrete cycles, each discrete cycle comprising a first portion in which a predetermined volume of liquid flavoring is drawn into the diaphragm pump from the liquid reservoir, and a second portion in which the predetermined volume of liquid flavoring is expelled from the pump through a dispensing outlet;

c) a pulse generator configured for generating discrete pulses, each discrete pulse causing the diaphragm pump to move through one discrete cycle; and d) a controller having a timing circuit configured for generating electrical pulses, the timing circuit powered by a DC power source;

e) the controller configured to:

i. receive a user request for a particular beverage;

ii. determine a number of discrete pulses to be generated based on at least one of: a signal relating to a volume of the liquid flavoring to be dispensed, at least one variable associated with the liquid flavoring, a preset parameter associated with the liquid flavoring, and an input associated with the user request; and iii. activate the pulse generator to generate the number of discrete pulses by selectively coupling and decoupling the pulse generator to the timing circuit, each pulse of the pulse generator causing the diaphragm pump to move through one discrete cycle such that the predetermined volume of liquid flavoring is expelled from the diaphragm pump via the dispensing outlet.

10. The apparatus of claim 9, wherein the predetermined volume of liquid flavoring is less than about 0.1 ml.

11. The apparatus of claim 9, wherein the predetermined volume of liquid flavoring is less than about 0.05 ml.

12. The apparatus of claim 9, wherein the predetermined volume of liquid flavoring is on the order of about 0.01 ml.

13. The apparatus of claim 1, further comprising a timing circuit operatively coupled to the controller for generating electrical pulses, and wherein the controller is configured to selectively couple and decouple the pulse generator to the timing circuit to generate the discrete pulses.

14. The apparatus of claim 13, wherein the timing circuit is powered by a DC power source.

15. The apparatus of claim 1, wherein the pulse generator includes an AC power source, each discrete pulse is an electrical pulse supplied by the AC power source, and the controller is operable to selectively permit and prevent the transmission of electrical pulses between the AC power source and the pump to generate the discrete pulses.

16. The apparatus of claim 1, wherein the pump chamber has a volume on the order of about 0.01 ml.

17. The apparatus of claim 9, wherein the diaphragm pump comprises:

a) a housing with inner walls that define a pump chamber, the housing defining a fluid inlet in communication with the liquid reservoir and the pump chamber, and the housing having a fluid outlet in communication with the pump chamber and the dispensing outlet for dispensing the liquid flavoring, and b) a flexible diaphragm movable within the pump chamber between a first position and a second position, wherein the predetermined volume of liquid flavoring is drawn from the liquid reservoir into the pump chamber when the diaphragm moves from the first position to the second position, and the predetermined volume of liquid flavoring is expelled from the pump chamber when the diaphragm moves from the second position to the first position.

18. The apparatus of claim 17, wherein the pump chamber has a volume less than about 0.01 ml.

* * * * *